US006604044B1

(12) United States Patent
Kirk

(10) Patent No.: US 6,604,044 B1
(45) Date of Patent: Aug. 5, 2003

(54) METHOD FOR GENERATING CONFLICT RESOLUTIONS FOR AIR TRAFFIC CONTROL OF FREE FLIGHT OPERATIONS

(75) Inventor: Daniel B. Kirk, Vienna, VA (US)

(73) Assignee: The Mitre Corporation, McLean, VA (US)

( * ) Notice: Subject to any disclaimer, the term of this patent is extended or adjusted under 35 U.S.C. 154(b) by 0 days.

(21) Appl. No.: 10/073,956

(22) Filed: Feb. 14, 2002

(51) Int. Cl.[7] ..... G06G 7/76
(52) U.S. Cl. ..... 701/120; 701/1
(58) Field of Search ..... 701/120, 121, 701/122, 1, 3, 14

(56) References Cited

U.S. PATENT DOCUMENTS

| | | | |
|---|---|---|---|
| 4,063,073 | A | 12/1977 | Strayer |
| 4,196,474 | A | 4/1980 | Buchanan et al. |
| 4,823,272 | A | 4/1989 | Inselberg |
| 4,839,658 | A | 6/1989 | Kathol et al. |
| 5,058,024 | A | 10/1991 | Inselberg |
| 5,157,615 | A | 10/1992 | Brodegard et al. |
| 5,179,377 | A | 1/1993 | Hancock |
| 5,381,338 | A | 1/1995 | Wysocki et al. |
| 5,627,546 | A | 5/1997 | Crow |
| 5,631,640 | A | 5/1997 | Deis et al. |
| 5,732,384 | A | 3/1998 | Ellert et al. |
| 5,838,262 | A | 11/1998 | Kershner et al. |
| 5,872,526 | A | 2/1999 | Tognazzini |
| 5,961,568 | A | 10/1999 | Farahat |
| 6,043,757 | A | 3/2000 | Patrick |
| 6,054,937 | A | 4/2000 | Von Viebahn et al. |
| 6,085,150 | A | 7/2000 | Henry et al. |

FOREIGN PATENT DOCUMENTS

DE 0493822 A1 * 12/1991 ..... G01S/7/20

* cited by examiner

*Primary Examiner*—Yonel Beaulieu
(74) *Attorney, Agent, or Firm*—Rosenberg, Klein & Lee

(57) ABSTRACT

A computationally efficient method for automatically generating lateral resolutions for air traffic control problems for a given aircraft allows for prediction and evaluation of required separation between aircraft, between aircraft and airspace, and problems with assigned metering time. Upon a possible problem being predicted, lateral resolutions are created which provide plans to re-route the original flight trajectory of the aircraft in order to avoid a possible problem by examining the space surrounding the aircraft, iteratively adding data on each conflict encountered into a conflict database, calculating and probing maneuver trajectories for all conflicts in the conflict database, and selecting the most appropriate of the created maneuver trajectories.

15 Claims, 16 Drawing Sheets

TYPE 1: DIRECT DOWNSTREAM VOR

TYPE 2A: DIRECT FROM VOR TO ORIGINAL ROUTE

TYPE 2B: DIRECT FROM VOR TO RADIAL ORIGINATING FROM VOR ON ORIGINAL ROUTE

TYPE 3: REROUTE THROUGH ONE VOR

TYPE 4: REROUTE THROUGH TWO VORS

TYPE 5: HEADING OFF ROUTE FOLLOWED BY DIRECT TO VOR

TYPE 6: VECTORS

METHOD FOR GENERATING CONFLICT RESOLUTIONS FOR AIR TRAFFIC CONTROL OF FREE FLIGHT OPERATIONS

FIELD OF THE INVENTION

The present invention relates to problem resolution support for free flight operations; and particularly, to a system and method for a computerized problem resolution to assist the route sector controller team in handling conflict traffic patterns by providing the capability of problem analysis and resolution of aircraft-to-aircraft, and aircraft-to-airspace problems, metering constraints and other traffic flow management parameters, including but not limited to avoidance of severe weather areas.

More particularly, the present invention relates to lateral maneuver generation for avoidance of conflict containing space blocking in accordance with right and/or left turn maneuvers to be generated in view of information contained in left and right conflict data bases using multiple iterative steps with the addition of updated conflict information to the conflict data base during each pass.

Further, the present invention relates to a system and method for problem analysis and resolution for free flight operations whereupon at a controller's initiation, the system provides a set of candidate problem resolution advisories for a selected type of maneuver to be performed by the aircraft or for a specified aircraft problem.

Additionally, the present invention relates to calculation of a problem free block of an effectively continuous search space based on iterative principles. Maneuver parameters are calculated based on relative motion geometry to estimate the effects of planned speed changes and changes in vertical, lateral and longitudinal separation between the subject aircraft and a conflict aircraft in their mutual interdependency to each other.

BACKGROUND OF THE INVENTION

In order to meet user demands and to accommodate growth in traffic, Federal Aviation Administration and National Air Space System users have embarked on an initiative known as free flight. Free flight provides users with as much flexibility in flight as possible while maintaining or increasing National Airspace System safety and predictability. The more complex traffic patterns that can result from a less structured free flight environment require enhanced problem resolution capabilities to assist the en route sector controller team in handling possible conflict situations.

As one of the free flight problem resolution supports, the User Requests Evaluation Tool (also referred to herein as URET) was developed which provides the enroute sector position controllers with automatic problem detection and trial planning capabilities, as well as a set of tools to assist in the management of flight data.

URET processes real time flight plan and track data from the National airspace system host computer, combines this data with site adaptation, key aircraft performance data, and weather conditions (such as winds and temperature) obtained from the National Weather Service in order to build four dimensional flight trajectories for pre-departure, inbound, and active instrument flight rules flights. URET also adapts its trajectories to the observed behavior of the aircraft and dynamically adjusts predicted speeds, climb rates, as well as descent rates based on the performance of each individual flight as it is tracked through enroute airspace.

URET uses the predicted trajectories to continuously detect potential aircraft problems up to 20 minutes in advance and provides a strategic alert to the appropriate sector. In addition, the predicted trajectories are the basis for the system's trial planning capability which permits the controller to check a desired flight plan amendment for potential problems before a clearance is issued.

A two-way interface of URET permits the controller to enter the trial plan as a host flight plan amendment with the click of a button. Although, URET provides enroute sector controllers with automatic problem detection and trial planning capabilities it lacks a problem resolution function which would be helpful to the flight controllers in supporting free flight operations.

SUMMARY OF THE INVENTION

It is an object of the present invention to provide a problem resolution support for free flight operations which would generate a set of candidate problem resolution advisories being presented to the controller of the flight for decision making.

It is another object of the present invention to provide a Problem Analysis, Resolution and Ranking (also referred herein further to as PARR) method which generates resolutions for aircraft-to-aircraft and aircraft-to-airspace problems as well as the resolutions for compliance with metering time constraints of free flight operations which may be initiated either for a selected type of maneuver or for a specified aircraft with one or more problems.

When used for a selected aircraft and/or a specific problem, PARR iteratively examines a variety of resolution dimensions and directions in search of problem free trajectories to resolve the problems with the specified aircraft without introducing new problem constraints (for a given aircraft to be maneuvered). If initiated for a specific problem for example, aircraft-to-aircraft problems, the resolutions for each of the involved aircrafts is generated.

It is a further object of the present invention to provide problem analysis and resolution techniques which calculate a block of air space that an aircraft must avoid and generates a maneuver advisory for a lateral maneuver using predefined maneuver types. Calculation of maneuver parameters based on relative motion geometry to estimate the effects of planned changes each to the other is performed.

In accordance with the teachings of the present invention, a method for generating problem resolutions for free flight operations in air traffic control is provided. The method includes the steps of selecting a subject aircraft to be maneuvered; and examining continuous space enveloping the subject aircraft for a predetermined look-ahead time interval. Resolutions are then; iteratively generated in response to each problem encountered in the examined continuous space according to the closest time to occurrence, and then sequentially adding newly discovered conflicts. The method further includes the steps of; calculating parameters of requested maneuvers based on relative motion geometry, proposing a predefined maneuver of the subject aircraft; and probing each generated resolution by further examining the continuous space enveloping the subject aircraft affected by each requested maneuver.

The aforementioned functions are implemented by the Problem Analysis Resolution and Ranking (PARR) system. PARR system is well suited for generating resolutions to maneuver the subject aircraft to meet pre-assigned metering constraints, such as time of arrival, etc. PARR system operates by (a) defining a pre-conflict path constraint for the subject aircraft, which comprises straight line flight segments, (b) defining start point, end point, turn point, and off-angle of the maneuver, and (c) re-routing the aircraft through a series of fixes with respect to the flight segments in predefined off-angle parameter increments being initiated at a start point, turning the subject aircraft at a turn point, and returning the aircraft to the flight segment at an end point of the maneuver.

The dimensions of the continuous space enveloping the subject aircraft are determined by defining the required separation between a subject aircraft and a potential problem.

In PARR system, the merits of each specific maneuver are evaluated by generating a plurality of resolutions in response thereto. Thus, PARR technique is well suited for evaluation of any amendments intended to change initial flight parameters prior to approval of these amendments.

In the PARR system, a problem summary structure is formed, and data is collected which include the subject aircraft's headings, speeds, and transitioning states at the current time. The collected data also includes; the encountered problem's start and end times, predicted headings, speeds, transitioning states of the subject aircraft at the start and end times; minimum and maximum altitudes and true airspeeds of the subject aircraft. The system also, stores the data in the problem summary structure, and processes the data for generating the resolutions.

The lateral maneuvers include a number of types including: Direct to Maneuver end Point, Minimum Off-Angle, and Fixed Off-Angle. Vertical maneuver generated by PARR includes the above problem maneuver shapes such as Increase Altitude, Extend Climb, Early Climb, Early Extend Climb, and Step Late Descent, or the below-problem maneuver shapes, which include Decrease Altitude, Step Climb, and Step Early Descent. Longitudinal maneuvers are generally directed to speed increase or speed decrease. Each of the generated maneuvers is compatible with the operational performance envelope of the subject aircraft.

The maneuver's parameters include turn angles and speed changes of the calculated maneuvers displayed in predefined magnitude increments. Upon completion of each maneuver, PARR returns the subject aircraft to its previous route and altitude profile.

In generating a lateral maneuver, PARR creates first and second conflict databases for respectively generating maneuvers to the left and right of the initial conflict. During each examination of the continuous space enveloping the subject aircraft, PARR adds newly discovered conflict information to a respective one of the first and second databases and then generates a resolution requesting the lateral maneuver which is intended to avoid each problem event stored in the first and second conflict databases.

PARR system determines a maneuver start point (MSP) for a Minimum Off Angle (MOA) maneuver for each discovered conflict by determining an initial MOA MSP that starts at a parameter time in the future, and for each conflict added to the conflict data base in each examination pass the MSP of a maneuver is determined by calculating a set of MSP prohibited turn intervals. The smallest MSP turn angle is selected outside of the set of MSP prohibited intervals, and an initial MSP is moved down the trajectory of the subject aircraft if the selected smallest MSP turn angle exceeds a predefined angle value, PARR system determines a Maneuver Turn Point (MTP) and a Maneuver End Point (MEP) of an MOA maneuver by; determining an initial MEP for the MOA maneuver, and calculating a set of MTP prohibited turn intervals for each problem encountered in the conflict data base. The MTP turn angle is selected outside the set of MTP and MEP prohibited turn intervals, and the initial MEP for the MOA maneuver is moved down the trajectory of the subject aircraft if the selected MTP or resultant MEP turn angles exceed predefined limits.

Subsequent to determining the MTP and MEP of an MOA maneuver the MSP, MTP and MEP for a fixed off angle (FOA) maneuver are determined by; determining initial MSP and MEP for the FOA maneuver, calculating a set of MTP prohibited turn intervals for each problem in the conflict data base, and selecting the MTP turn angles outside the set of MTP prohibited turn intervals. The MSP is then moved downstream until outside of the set of MTP prohibited turn intervals, and the initial MEP for the FOA maneuver is moved down the trajectory of the subject aircraft if the selected MTP or resultant MEP turn angles exceed predefined limits.

Further a selection is made between an optimized MOA and FOA maneuver based on predefined criteria, for example, path length. PARR then creates the selected maneuver trajectory, probes the created trajectory of the selected maneuver for problems, and acknowledges the created maneuver trajectory as the most appropriate if the maneuver trajectory is found to be problem free. If, however, the created maneuver trajectory encounters a problem, PARR system moves the MEP calculated for the MOA and FOA maneuvers past the last problem in the conflict data base and repeats all steps for determining a Maneuver Start Point, Maneuver End Point, and Maneuver Turn Point for MOA maneuvers as well as Maneuver Turn Point and Maneuver End Point for FOA maneuvers. This process is repeated until a conflict-free maneuver is found, an iteration limit is reached, or further MSP or MEP movement is not possible (e.g., the MEP is at the destination).

These and other novel features and advantages of the subject invention will be more fully understood from the following detailed description of the accompanying Drawings.

DESCRIPTION OF THE PREFERRED EMBODIMENT

The Problem Analysis, Resolution and Ranking (also referred to herein as PARR) is a computationally efficient technique for generating resolutions for air traffic control aircraft problems for a given aircraft with path constraints to insure that the resolutions may be easily cleared to the pilot of the aircraft, with an optimized flight plan. The problems addressed by PARR system and method include predicted violation of required separation between aircrafts (aircraft to aircraft conflicts), between a given aircraft and airspace (aircraft to airspace conflicts, such as an aircraft and a military operation airspace, or an area of severe weather), as well as assigned metering time problem areas.

Figure 1:
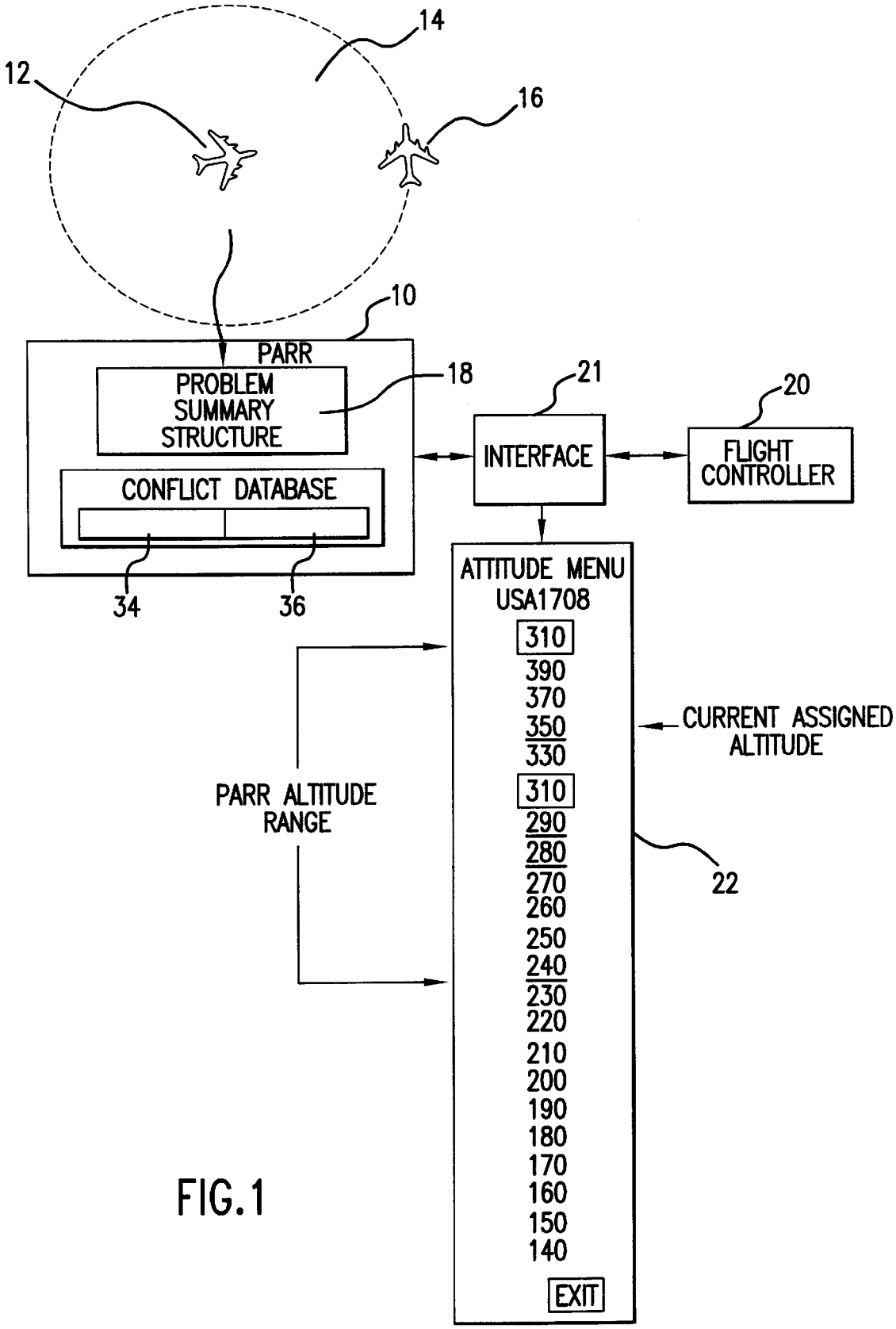
FIG. 1 is a schematic representation of the Problem Analysis, Resolution and Ranking (PARR) system of the present invention.

Referring to FIG. 1, PARR system 10, which is envisioned as a problem resolution support for free flight operations, supervises a subject aircraft 12, examines the continuous space 14 enveloping the aircraft 12 for a predetermined look-ahead time interval (which is usually 20 minutes) in order to detect a potential aircraft problem 16. The system gathers data concerning the subject aircraft 12 in view of the encountered problem, stores the obtained data in a problem summary structure 18, processes the obtained data, and at a flight controller 20 initiation, provides a set of candidate problem resolution advisories in the form of Trial Plans which are presented to the flight controller 20 via the interface 21 in one of two ways depending on whether PARR 10 is initiated (a) for a selected type of a maneuver (to assign a new speed, altitude, or direct-to-fix maneuver); or (b) for a specified aircraft or a problem.

The primary path constraint addressed by PARR is the limitation of the maneuver of the subject aircraft to one or two straight line flight segments (maneuver "leg") for re-routing the aircraft through a series of fixes. Additional constraints which may be imposed are that 1) Maneuver End Points (MEPs) occur at a clearable fix (e.g., a very high frequency omni-directional range, also referred herein as VOR, navigation aid), 2) Maneuver Turn Points (MTPs) and Maneuver End Points (MEPs) be navigable by an aircraft restricted to using VORs for navigation, and 3) Maneuver Off-Angle Turns be clearable in parameter increments as will be detailed in following paragraphs.

PARR procedure may be initiated for a selected type of a maneuver, i.e., to assign a new speed, altitude, or direct to fix maneuver. Initiation occurs automatically when a Trial Plan Menu 22 for the corresponding maneuver type is displayed. As an example, when displaying the Trial Plan Altitude Menu (illustrated in FIG. 1), PARR 10 is automatically initiated to generate a range of Trial Plans for a newly assigned altitude with this range being dependent on the current and assigned altitude of the aircraft as well as its phase of flight. A color code for each resulting trial plan is used to color code the menu entry. In this manner, the controller 20 determines which entries are problem free by viewing the menu 22. For instance, the problem free altitude such as 350, 290, 280 and 240, underlined are shown in a predetermined color such as green to designate problem free resolutions.

PARR generates a range of trial plans whether or not a problem is detected in the selected aircraft's current plan. Thus, PARR may be used to check the problem status of a desired action, e.g., to change an assigned altitude due to amendments or to send the aircraft directly to a downstream fix.

In addition to PARR capabilities for a specific maneuver type, the PARR system may also be initiated for a specific aircraft with one or more problems, or for a specific problem. In these cases, PARR 10 examines a variety of resolution dimensions and directions. The resolutions may have multiple clearance components, e.g., a Step Climb Maneuver consisting of a Climb to a Level of Altitude, followed by a Resumption of Climb. If initiated for an aircraft, PARR generates resolutions which only maneuver the subject aircraft. If initiated for an aircraft to aircraft conflict resolutions for each of the involved aircraft is generated.

Although multiple aircraft maneuvers for each resolution are contemplated in PARR, for the sake of simplicity of understanding the principles of the present invention, only maneuvering of one aircraft for each resolution will be described in further paragraphs. For a given aircraft 12 to be maneuvered, PARR searches for a problem free trajectory to resolve problems which the particular aircraft may encounter with a 20 minute look-ahead horizon in an operationally acceptable manner without introducing new problems.

After selecting an initial conflict for resolution from the set of problems for a given aircraft, the search process examines maneuvers in each of the following five dimensions/directions, thus building up to five resolutions for the subject aircraft: (a) above the conflict, (b) below the conflict, (c) left of the conflict, (d) right of the conflict, and (e) an increase or decrease in speed of the aircraft. As disclosed herein each resolution contains only one maneuver, although multiple dimension maneuvers for each resolution are contemplated in scope of PARR system.

The completed PARR resolutions are ranked and displayed on the display for a flight controller 20 to select and implement one of the displayed resolutions. Alternatively, the controller 20 may use the resolution set to estimate which maneuver dimensions/directions are candidates for further inspection. Additionally, the number of successful resolutions available may be used by the flight controller as an ongoing indicator of when maneuver options are becoming limited and possible actions to be taken to resolve the problem. Each PARR resolution is a complete trial plan which returns the maneuvered aircraft to its original route, destination, or transition, in appropriate magnitude increments (e.g., 5 degree increments for turns and 10 knot increments for speed). All maneuvers are calculated in a manner to maintain the maneuvered aircraft within its operational performance limits.

When initiated for a selected aircraft or problem, PARR processing consists of three steps: problem analysis, resolution generation, and resolution ranking.

Problem Analysis

In the first step of PARR processing PARR collects data for each aircraft to be maneuvered for use in resolution process, such as:

aircraft headings, speeds, and transitioning states at the current time;

conflict start and end times, and the predicted aircraft headings, speeds, and transitioning states at the problems start and end times;

aircraft minimum, maximum altitudes and true air speeds;

sector and facility currently controlling the aircraft.

The above information is collected and stored in the problem summary structure 18 and is used throughout the resolution and ranking components of PARR 10 as will be described in further paragraphs.

Resolution Generation

In the second step of PARR processing, i.e., resolution generation, low level functions are used to create the resolution planned actions and to build resolution trajectories. The resolution algorithm iterates for the subject aircraft, the other maneuvered aircraft (if PARR was initiated for a specified problem), and all dimensions/directions for each aircraft. Each dimension further calls aircraft and airspace problem resolution routines to model resolutions. If the problem is solved, the current operation limit is adjusted and the current direction will be skipped in subsequent operation. Otherwise, the current best resolution (according to a ranking criteria described in future paragraphs) is stored in a data structure for the next iteration.

Resolution generation is terminated when at least one of the following conditions is specified:

(1) for each aircraft and each dimension/direction, one of the following conditions holds:

(a) a problem free resolution has been found;

(b) all problems remaining are tactical problems with the current plan, and PARR has not made them more disadvantageous (i.e., PARR has not increased the alert severity, or decreased the problem start time). "Tactical" problems are the problems having a start time earlier than a parameter time in the future such as for example 3 minutes or other predetermined time interval;

(c) the system has determined that a resolution in the given dimensions/directions would exceed the operational performance limits of the maneuvered aircraft.

(2) An initial iteration limit (counting all iterations for each maneuvered aircraft and resolution dimension/direction) has been reached, and at least one resolution has been generated satisfying condition of a problem free resolution or all problems remaining are tactical problems has been generated.

(3) A second iteration limit has been reached.

In the unlikely event that no resolutions are generated the flight controller is notified that no resolutions are available.

PARR, as a resolution for encountered problems, generates either of three maneuver dimensions, such as lateral maneuvers, vertical maneuvers, and longitudinal maneuvers. Lateral maneuvers are categorized according to whether the maneuvered aircraft initially turns left or right of the initial conflict. For a given aircraft, PARR typically attempts both of these lateral maneuvers. Lateral maneuvers may use either point to point (PTP) or very high frequency omni-directional range (VOR) navigation logic depending on the equipage identifier of the aircraft. PTP navigation maneuvers permit a lateral maneuver to be generated to a latitude/longitude point or a VOR fix/radial/distance (FRD). VOR navigation maneuvers generally use VOR radials for navigation of the maneuver, thus requiring only VOR aircraft navigation equipment. Vector maneuvers with heading clearances may be given when an acceptable maneuver using VOR radials cannot be found.

Point to point maneuvers are one of three maneuver types: Direct to Maneuver End Point (MEP), Fixed Off Angle, or Minimum Off Angle. A Direct to MEP maneuver occurs when an aircraft proceeds directly from the MSP (Maneuver Start Point) to the MEP (Maneuver End Point) and there are no intermediate turns. The Minimum Off Angle maneuver, shown in FIG. 2B, uses the minimum angle 24 necessary to pass around the problem, i.e., another aircraft 26 involved in the problem. The Fixed Off Angle maneuver, shown in FIG. 2A, has a first maneuver leg 28 with a fixed initial turn angle 30 (typically 60 degrees); this is a maneuver in which it is either inefficient or not possible (with the given left or right turn) to pass around the problem on the first maneuver leg 28. From the first maneuver leg 28, the subject aircraft 12 turns at the maneuver turn point MTP to follow the second maneuver leg 32 to the maneuver end point MEP.

Figure 3A:
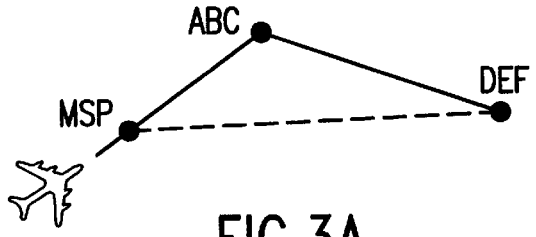
FIGS. 3A–3G illustrate various VOR lateral maneuvers.
Figure 3B:
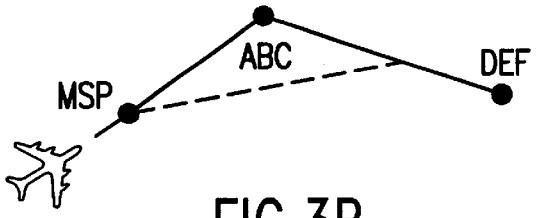
Figure 3C:
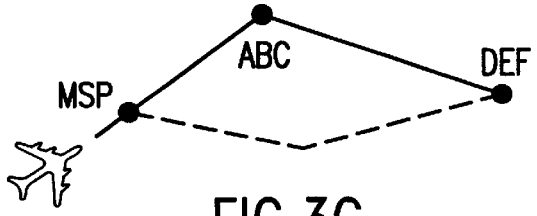
Figure 3D:
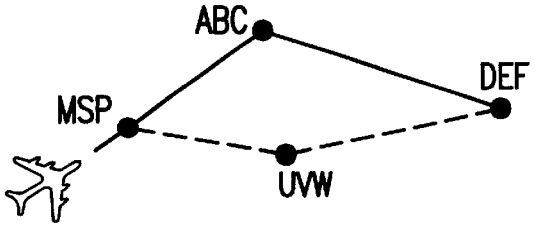
Figure 3E:
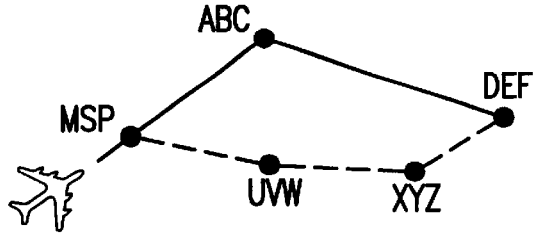
Figure 3F:
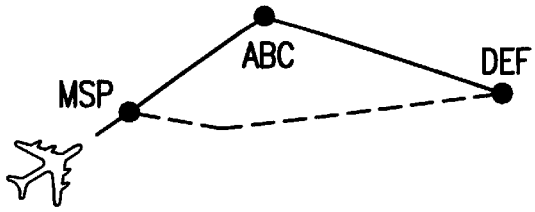
Figure 3G:
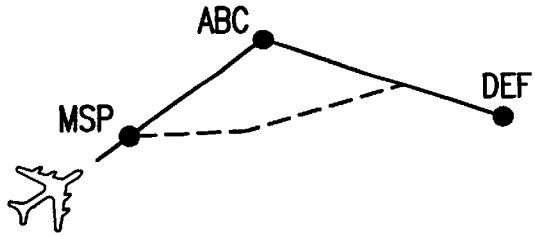

As shown in FIG. 3, the VOR maneuvers may include six maneuver types, such as:

Type 1: Direct Downstream VOR (shown in FIG. 3A),

Type 2 which is broken into two sub-types: direct from a VOR to the original route (FIG. 3B) and direct from a VOR to a radial originating from a VOR on the original route (FIG. 3C);

Type 3: reroute through one VOR (FIG. 3D);

Type 4: reroute through two VORs (FIG. 3E);

Type 5: heading off route followed by direct to VOR (FIG. 3F); and

Type 6: radar vector (FIG. 3E).

Figure 2B:
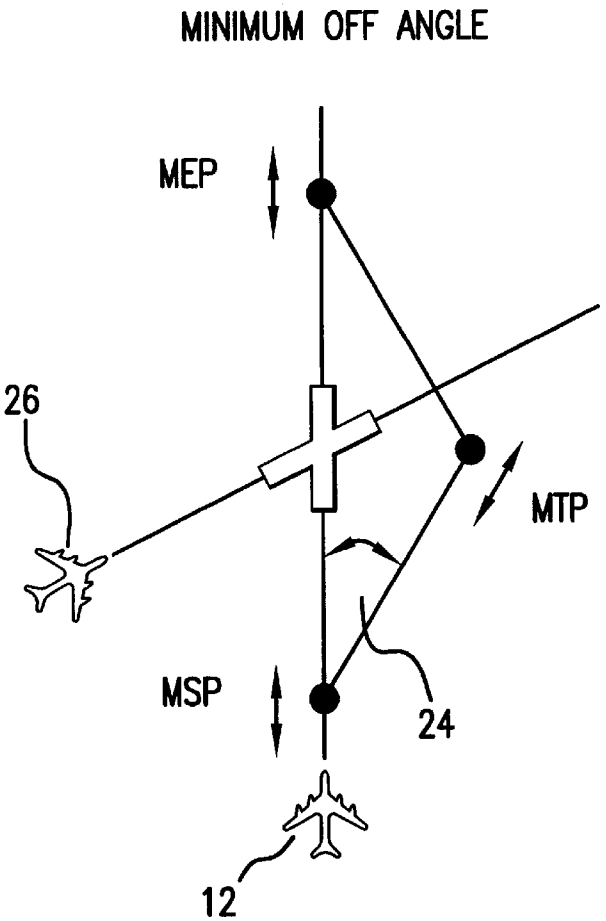
FIGS. 2A and 2B illustrate Fixed Off Angle (FOA) and Minimum Off Angle (MOA) lateral maneuvers.
Figure 2A:
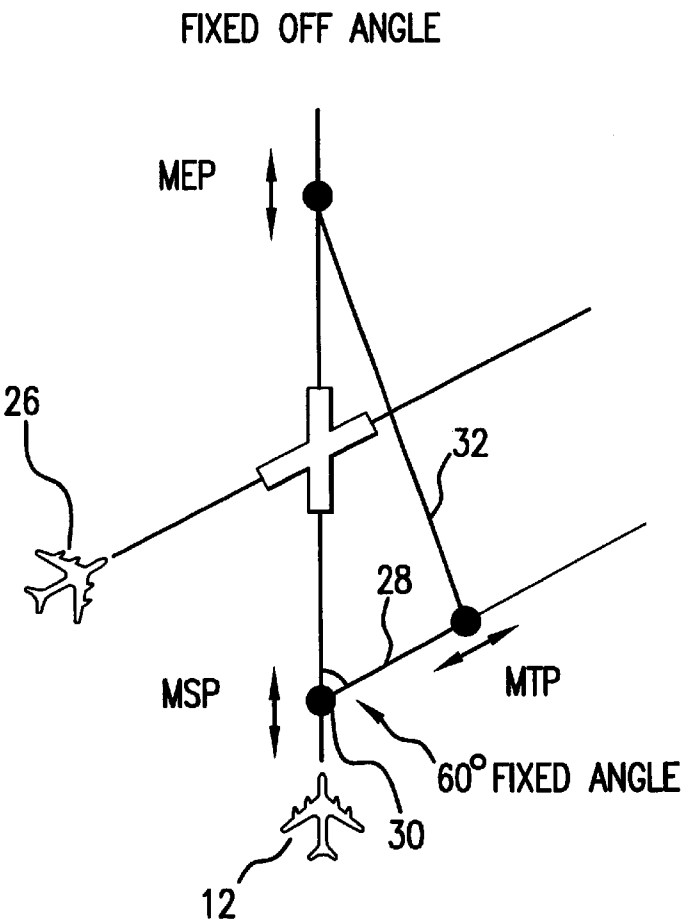

Both Point to Point and VOR maneuver generation are iterative. During each pass, a proposed resolution is created, and, if objections are found and the iteration limit has not been reached, the process is repeated using the proposed resolution created as an input. If possible, two lateral maneuvers will be generated: one to the left of the initial conflict (termed as a "left maneuver") and one to the right of the initial conflict (termed a "right maneuver"). As in all resolution maneuvers, lateral maneuvers have a maneuver start point MSP and end point MEP that lie on the aircraft trajectory as shown in FIGS. 2A and 2B.

Some lateral maneuvers such as direct maneuvers, or direct to MEP maneuvers, go directly from the MSP to the MEP with no MTP. The initial bearing which is the portion of a maneuver that is taken at the MSP to take the aircraft off the trajectory and directly to the MTP or MEP is called the off bearing. The return bearing is a bearing that is taken at the MTP to return the aircraft back to the MEP on the original trajectory path. The return bearing is not applicable if the lateral resolution is a direct maneuver.

PARR control loop, described in detail in further paragraphs, with regard to FIGS. 12–15 invokes lateral maneuver generation (LMG) procedure to generate left or right maneuvers. PARR control loop invokes LMG numerous times to find a resolution. During each pass, the purpose of LMG is to create a maneuver that avoids each conflict in the data base. LMG maintains two conflict data bases 34 and 36 (best shown in FIG. 1), one for generating left maneuvers, and one for generating right maneuvers.

LMG procedure adds newly discovered conflict information to its data base during each pass of examining the continuous base 14 enveloping the subject aircraft 12. At the start of the first pass, the respective one of the left and right conflict data bases 34 and 36 is initialized by the primary conflict which is the initial problem that the flight controller 20 desires to solve.

If PARR was invoked to solve multiple conflicts on an aircraft, then the primary conflict is defined as a conflict that is predicted to occur earliest. Thereafter, each time the control loop invokes LMG procedure for a right maneuver, a new conflict from the previous right maneuver trial plan (TP) probe result (the conflict that is predicted to occur earliest) is added to the right maneuver conflict data base 36. Each time the control loop invokes LMG procedure for a left maneuver, a new conflict from the previous left maneuver trial plan probe result (the one which is predicted to occur earliest) is added to the left turn conflict data base.

During each pass, LMG procedure creates a single (right or left) maneuver that avoids each conflict in the respective, right or left, data base. In generating the maneuver, LMG procedure chooses a specific MSP, MEP, and, if applicable, MTP. The maneuver is incorporated into a set of planned actions that are submitted to a system called the User Request Evaluation Tool (URET) which is capable of building a trial plan and probing it. If any conflicts are found, the conflict that is predicted to occur earliest is added to the data base when the left or right LMG procedure is invoked again.

For left maneuvers, LMG chooses an off bearing that directs the subject aircraft to pass left of the initial conflict, while for right maneuvers, lateral maneuver generation chooses an off bearing that directs the subject aircraft to pass right of the initial conflict.

Figure 4:
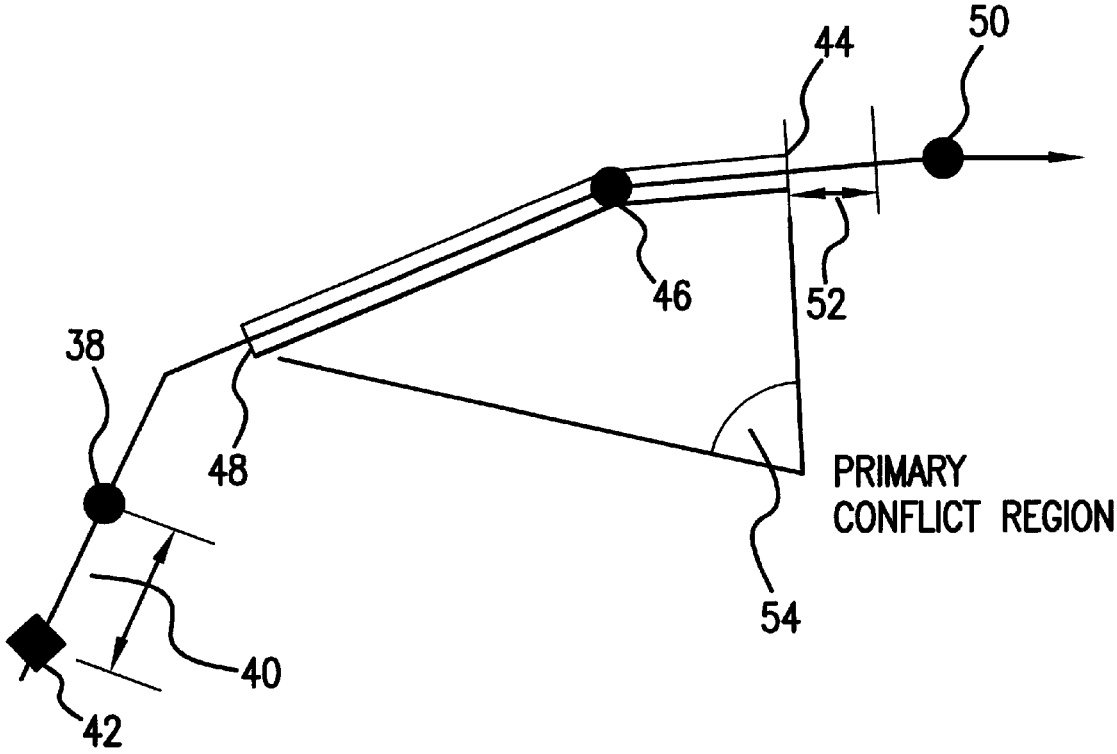
FIG. 4 illustrates a procedure of calculation of initial MSP (Maneuver Start Point) and MEP (Maneuver End Point) for a lateral maneuver.

The initial lateral maneuver generation procedure calculates an MSP 38 based on an adapted time interval 40 after the current time 42, as shown in FIG. 4.

Each time when LMG procedure is invoked by PARR control loop, LMG attempts to build two types of maneuvers:

(1) Minimum off angle (MOA, best shown in FIG. 2B, where the maneuver uses the smallest off angle 24 possible in order to avoid each conflict contained in the conflict data base 34 or 36 (for respective maneuvers to the left and right of the initial conflict). The off angle, as detailed in previous paragraphs is a heading difference of the subject aircraft between the maneuver off bearing and the trajectory bearing at the MSP 38. For MOA maneuvers the MEP is after the primary conflict end point 44, shown in FIG. 4. (2) Fixed OFF angle (FOA), best shown in FIG. 2A, wherein the maneuver applies a fixed off angle 30, generally adapted at 60° to attempt to slow the aircraft down prior to the primary conflict. For the FOA maneuvers, the Maneuver End Point 46 (FIG. 4) is after the primary conflict start point 48.

When LMG procedure is initially invoked, LMG calculates an initial MEP 50 used for the MOA maneuver and an initial MEP 46 for the FOA maneuver as shown in FIG. 4. The initial MEP 50 for MOA maneuver is chosen to be the next downstream fix after an adapted time 52 subsequent to the predicted primary conflict termination.

The initial MEP 46 for the FOA maneuver is chosen to be the next downstream fix after an adapted time subsequent to the predicted initial conflict start. In either case, these fixes are named fixes for ease of clearance, with VORs being used for VOR-navigating aircraft.

Each time the LMG procedure is initiated following its first iteration (i.e., for a new or repeat conflict found in the first resolution attempt), the MSP or MEP may be moved. If the earliest conflict in the respective left or right database is predicted to end after the previous MOA or FOA MEP, that MEP is moved downstream after the respective conflict end.

Initial Off Bearing

Figure 5:
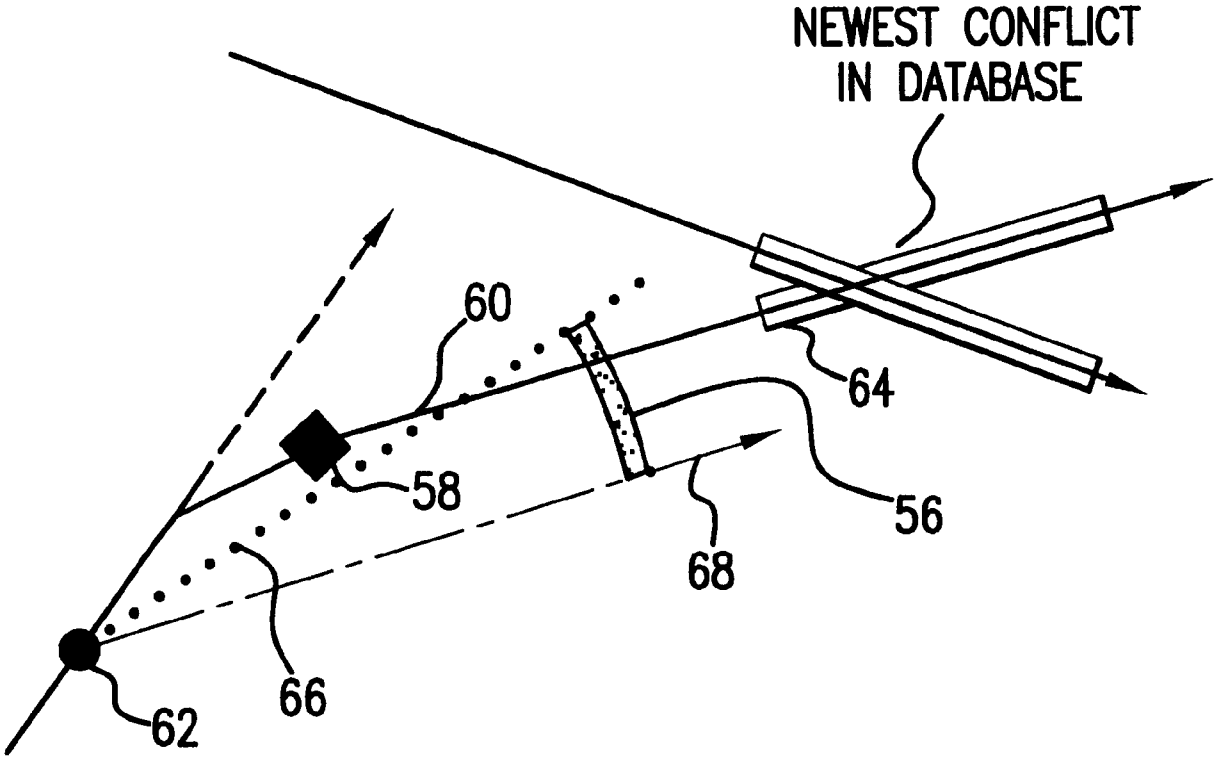
FIG. 5 illustrates a single wedge maneuver calculation.

From the last MOA maneuver start point (MSP) computed, LMG procedure computes an off bearing which avoids the last conflict entered into the data base. In order to accomplish this, wedge(s) of prohibited angle is computed which indicates those off bearing angles that the subject trajectory must avoid at the MSP in order to avoid losing separation with the object aircraft (from the last conflict). Referring to FIG. 5, a constant wind air mass technique is used to calculate the wedge 56. The wind value used is that at the point 58 of the subject trajectory 60 halfway between the MSP 62 (the left MOA MSP computed) and the conflict start point 64.

The algorithm (within LMG) for calculation of the wedge of prohibited bearings will be presented in the following paragraphs with regard to FIGS. 6–7, wherein $\overline{Po}$ is the position of the object aircraft (conflict), which coincides with the origin of the relative coordinate system;

$\overline{Pr}$ is the position of the subject aircraft at Maneuver Start Point (MSP) time in a relative coordinate system which has Po as the origin;

$\overline{Vo,a}$ is the airmass velocity vector (TAS) of the object aircraft;

$\overline{Vs,a}$ is the airmass velocity vector (TAS) of the subject aircraft;

$\overline{Vr,a}$ is the relative airmass velocity vector of the subject aircraft (relative to $\overline{Po}$);

$\overline{Vbr,a}$ is the relative velocity vector needed to clear $\overline{Po}$ by the required separation (SEPMR); and $\overline{Vbs,a}$ is the velocity vector of the subject aircraft needed to clear $\overline{Po}$ by the required separation (SEPMR).

The problem of the calculation process is to find $\overline{Vbs,a}$, the required velocity vector for the subject aircraft. Since the magnitude of $\overline{Vbs,a}$ is the same as the magnitude of $\overline{Vs,a}$, only the bearing of $\overline{Vbs,a}$ needs to be determined. To accomplish this, the angle y shown in FIG. 6 is to be determined, as follows:

$$\sigma = \arcsin\left(\frac{SEPMR}{|\overline{Pr}|}\right) \quad \text{(From Figure 6)}$$

$$\beta = |\text{bearing}(\overline{-Vo,a}) - \text{bearing}(\overline{-Vbr,a})| = |\text{bearing}(\overline{-Vo,a}) - (\text{bearing } \overline{Pr} \pm \sigma)|$$

Figure 6:
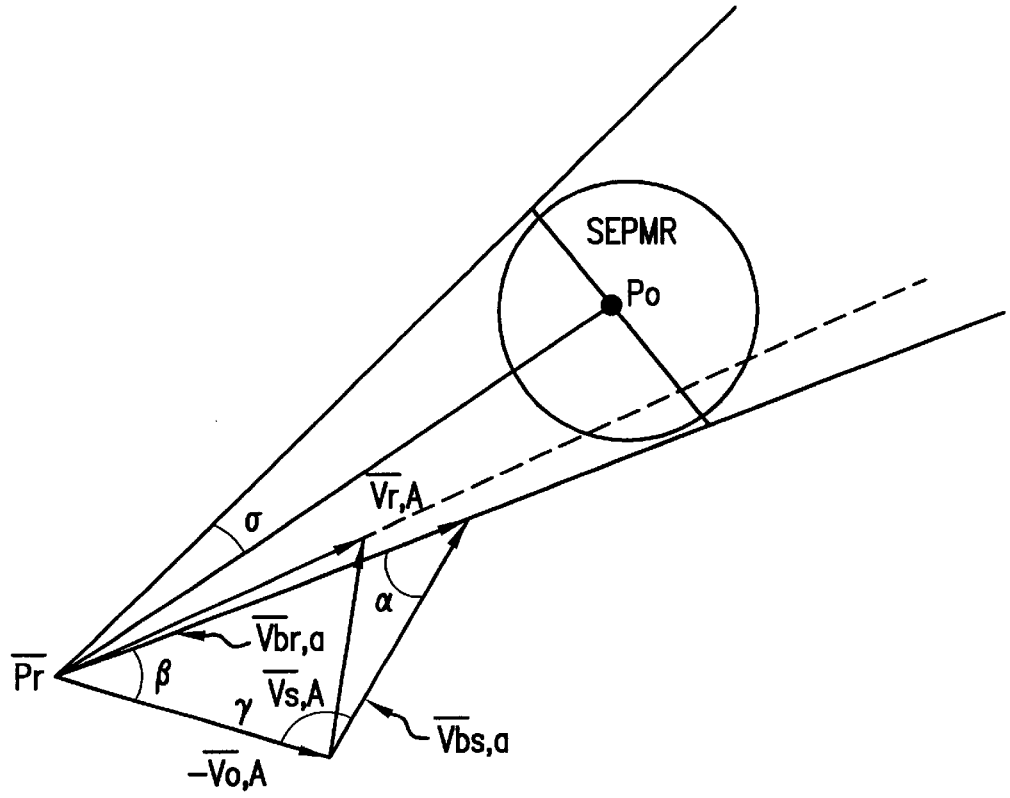
FIG. 6 illustrates the calculation of the wedge of prohibited bearings.
Figure 7:
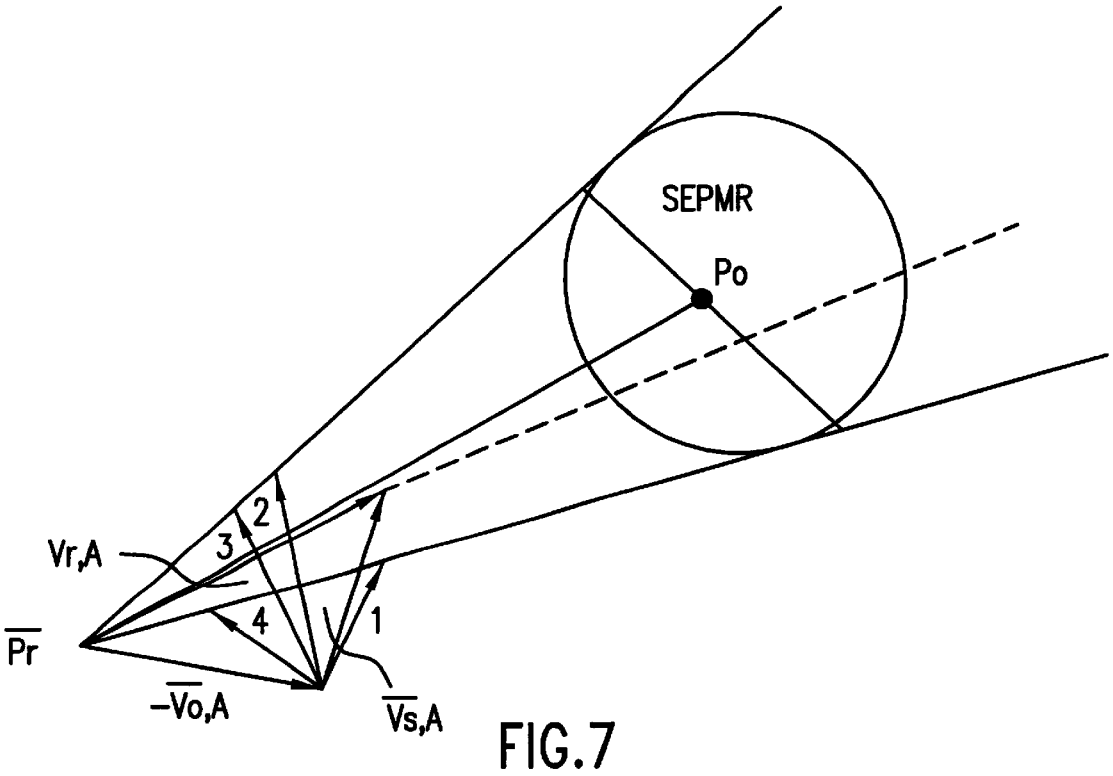
FIG. 7 illustrates the calculation of multiple wedge solutions.

(From FIG. 6)

Since by the law of sines:

$$\frac{\sin(\alpha}{|\overline{-Vo,a}|} \quad \frac{\sin(\beta)}{|\overline{Vbs,a}|} \quad \frac{\sin(\beta)}{|\overline{Vs,a}|}, \text{ then}$$

$$\alpha = \arcsin\left(\sin(\beta) * \frac{\lfloor \overline{Vo,a} \rfloor}{(|\overline{Vs,a}|)}\right).$$

$$\gamma = \pi - (\alpha + \beta)$$

(From FIG. 6).

Defining $SS$ as $SS = \text{sign}\ ((\overline{Vbr,a}) \times (\overline{-Vo,a}))$, then $$\text{bearing}(\overline{Vbs,a}) = \text{bearing}(\overline{-Vo,a}) + SS^*(\pi - \gamma).$$

The ground velocity is then given by the vector equation:

$$\overline{Vbs}=\overline{Vbs,a}+\overline{W},$$

where $\overline{W}$ is the wind vector.

While the preceding equations give the basic algorithm, there are two complicating factors which the LMG software must take into account. The first complicating factor relates to choosing the solutions which form the wedge of prohibited bearings. As shown in FIG. 7, there are up to four solutions for $\overline{Vbs,a}$ which will cause the two aircrafts to miss by the minimum required distance, and two wedges of prohibited bearings. In this case, LMG treats each wedge as a separate conflict in subsequent calculations.

The second complicating factor relates to choosing values for the aircraft velocity vectors. The algorithms needs constant velocity vectors for both aircrafts. Since this is not always the case, LMG determines the subject aircraft positions at MSP time and conflict start time, computes the distance between these two positions and divides them by the time interval. For the object aircraft, LMG uses the actual instantaneous velocity vector at conflict start time. However, for the position of the object aircraft at MSP time (which is needed to compute vector $\overline{Pr}$), LMG uses a pseudo position computed as if the object aircraft is perpetually traveling at the conflict start time velocity. Sometimes the wedge calculation cannot be performed. This occurs, for example, if the two aircraft are already within the protection circle, but are not yet in conflict due to being separated vertically. In cases like this which result in failure of the wedge calculation, LMG determines the wedge extending from the object aircraft position at the start of the conflict to the object aircraft position at the end of the conflict. A buffer is added to these object aircraft positions before calculating the wedge angles. This start-end-wedge is then used instead of the failed wedge.

Because the aircraft is moving in three dimensions, the aircraft may have regained vertical separation due to differences in timing. To account for this, a vertical-separation-wedge is computed that extends from the object aircraft position where vertical separation is lost, to the object aircraft position where vertical separation is regained. A buffer is added to these object aircraft positions before calculating the wedge angles. The wedge of prohibited angles is then reduced so that it does not extend beyond the vertical-separation-wedge.

If the wedge 56, shown in FIG. 5, cannot be computed due to the last conflict being too close to the MSP 62, then no further lateral maneuvers for that direction are generated. If a wedge is computed, the resulting wedge has to turn further to the left of the bearing limit 66 to avoid the conflict with a left maneuver at the MSP 62. Similarly, the subject aircraft has to turn farther to the right than the wedge right bearing limit 68, in order to avoid the conflict with a right maneuver at the MSP.

Modifications to the Off Bearing

Figure 8:
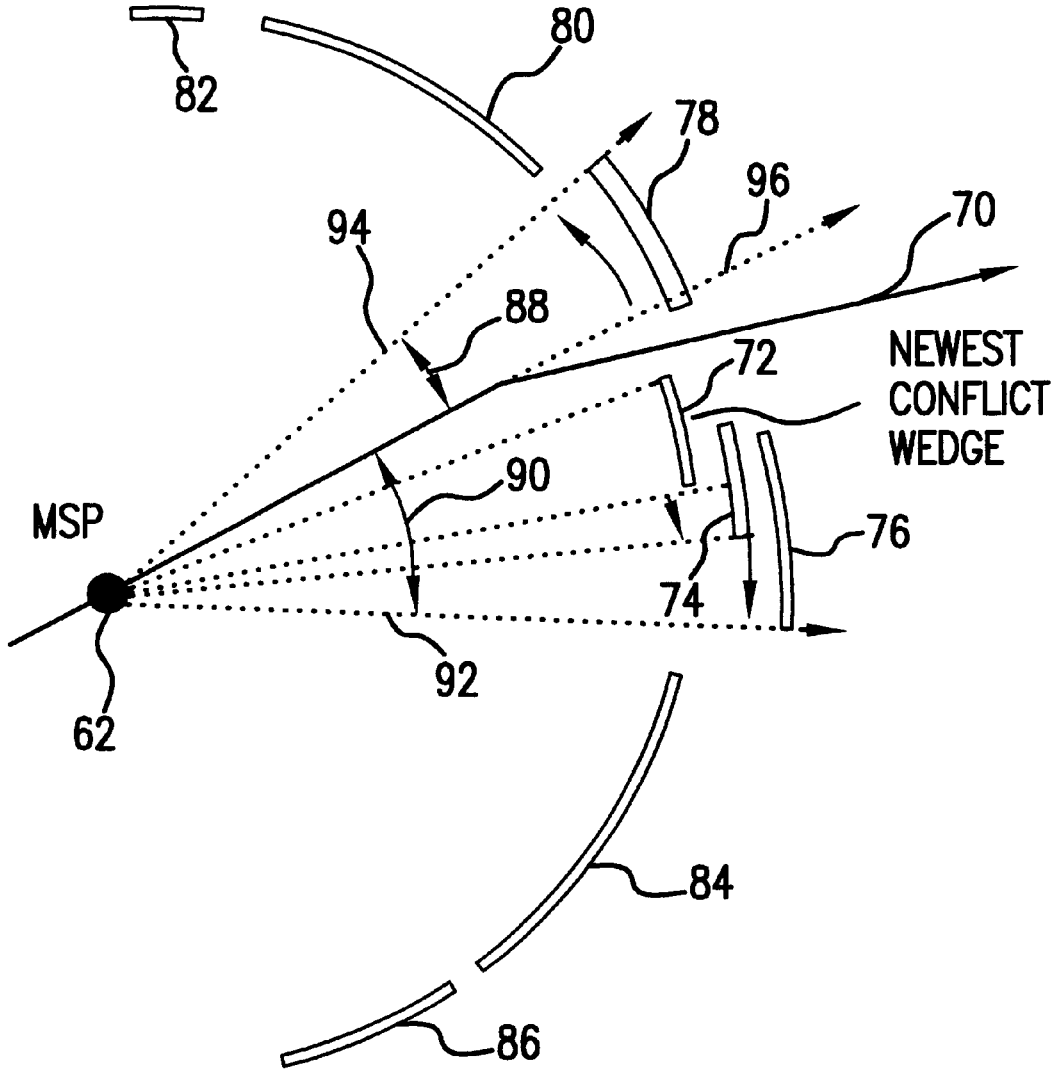
FIG. 8 illustrates the calculation of a modification to an Off bearing maneuver for multiple conflicts.

Once the initial off bearing is calculated, LMG procedure checks the wedges of all the other known conflicts. Referring to FIG. 8, if the initial off bearing intercepts any of the other wedges, the off bearing is set to the left (right) bearing limit of the intercepted wedge for left (right) maneuver generation; and the wedges are tested with this new off bearing. Any wedge that intercepts the off bearing causes the off bearing to be reset based on the bearing limits of the intercepted wedge.

Turn Angle Processing Loop

In FIG. 8, once an off bearing is found that does not intercept any wedges 72–86, a turn angle 88 or 90 is calculated as the absolute difference between the right off bearing 92 (or left off bearing 94) and the bearing of the current subject aircraft trajectory 96 at the MOA MSP 62. According to the formula:

$$\text{Turn angle}=\text{ABS (off bearing}-\text{subject aircraft bearing at MSP)}$$

If the resolution is to be cleared as a vector maneuver (i.e. as a change in heading), the off bearing increment is rounded to the left (or right) 5° adaptable interval.

If the turn angle is calculated is larger than the adapted angle 60°, LMG procedure will perform the following functions:

(1) LMG moves the MOA MSP downstream by 2 minutes (adaptable). The MOA MTP will be set to the new MOA MSP. After moving the MOA MSP, LMG procedure checks that the new MOA MSP time does not fall within 20 seconds (adaptable) prior to the primary conflict start time. If the new MOA MSP falls within this time then no solution is viable. Under these conditions no further lateral maneuvers are generated in the specified turn direction.

(2) Since the MSP was moved the wedges are no longer valid, a new wedge is calculated for every known conflict as described in previous paragraphs.

(3) An initial off bearing is chosen and checked against all recomputed wedges as described above.

(4) The turn angle is recomputed as described above. If the turn angle is still too large, steps 1–3 will be repeated until one or the other of the following happens:

(a) the MSP has been moved too close to the initial conflict, (b) a wedge cannot be computed because its associated conflict region is too close to the MSP, or (c) a turn angle is finally found that is acceptably small, i.e., less than the 60°.

Direct to MEP Test

After an off bearing is calculated that provides an acceptable turn angle, it may be possible to direct the aircraft directly to the MEP. LMG procedure calculates the bearing necessary to directly maneuver the aircraft from the MSP to the MEP, and checks if this direct bearing intercepts any calculated wedges. If no wedges are intercepted, an acceptable lateral maneuver is found and LMG procedure terminates by signaling PARR control loop to build a set of plan actions for this maneuver. If at least one wedge was intercepted, LMG procedure continues to build a two leg maneuver.

MTP Interval

Figure 9:
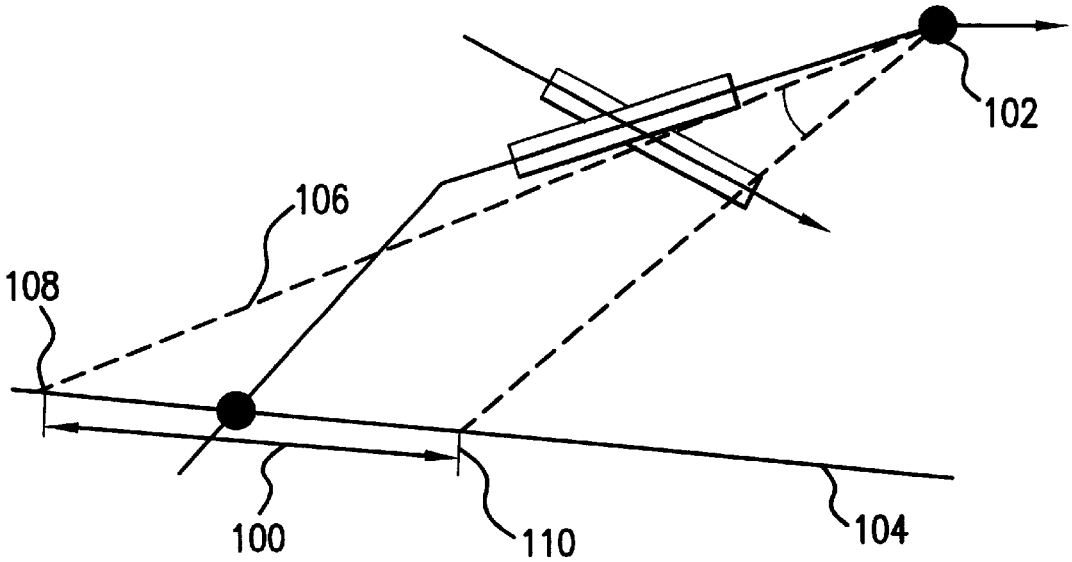
FIG. 9 illustrates the procedure of calculating an MTP (Maneuver Turn Point) interval.

If the direct to MEP maneuver is not possible, the LMG procedure calculates a maneuver turning point (MTP). The MTP lies somewhere along the off bearing line originating at the MSP. LMG procedure will determine the correct distance which the subject aircraft should travel along the off bearing line before turning the aircraft to head at the MEP. In order to determine the correct distance LMG calculates an MTP interval 100 for each known conflict, as shown in FIG. 9. An MTP interval is similar to the previously calculated wedge except that in this case it is based on the MEP 102 and is projected onto the off bearing line 104 originating from the MSP 106. The MTP interval calculations are described in further paragraphs with regard to FIGS. 11–12. The MTP interval 100 represents two points 108 and 110 along the off bearing line 104. In order to avoid a conflict, the subject aircraft (traveling on the off bearing line 104) must avoid a turn towards the MEP 102 while in between the MTP interval 100 associated with the conflict however it may turn to the MEP 102 before or after the MEP interval 100.

Figure 10:
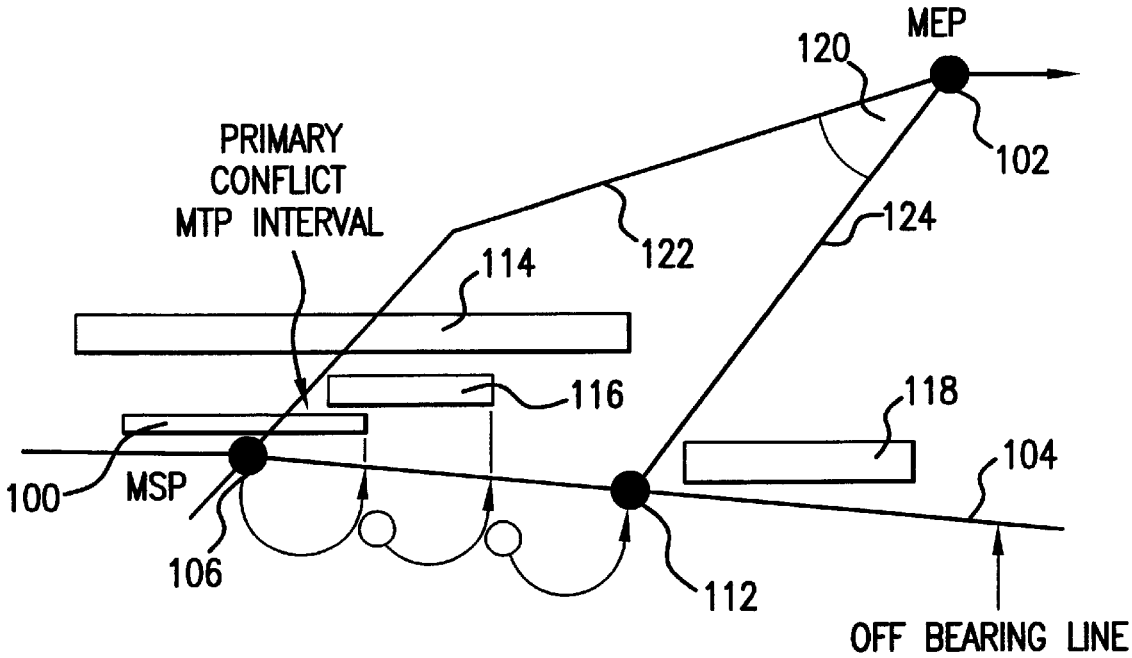
FIG. 10 is a procedure of determining an MTP for multiple conflicts.

LMG chooses an MTP that does not fall in any of the calculated MTP intervals. As shown in FIG. 10, LMG procedure chooses the MTP 112 to be the far side of the MTP interval 100 associated with the primary conflict. Then, LMG checks the MTP to see if it intercepts any interval associated with a known conflict. If the MTP chosen intercepts the interval, it is moved to the intercepted interval's far side and is checked with all the intervals and moved again if necessary. This process continues until an MTP is found which does not fall on any MTP intervals 100 and 114–118 shown on FIG. 10.

Figure 11:
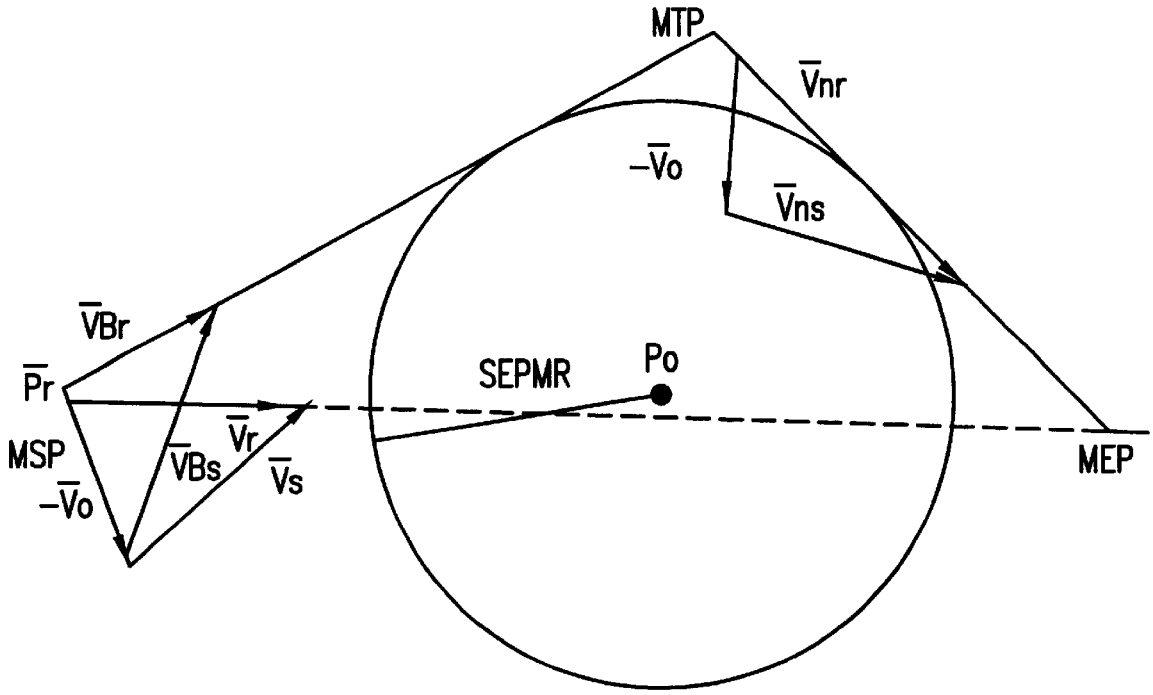
FIG. 11 illustrates the calculation of the prohibited turn-back interval.
Figure 12:
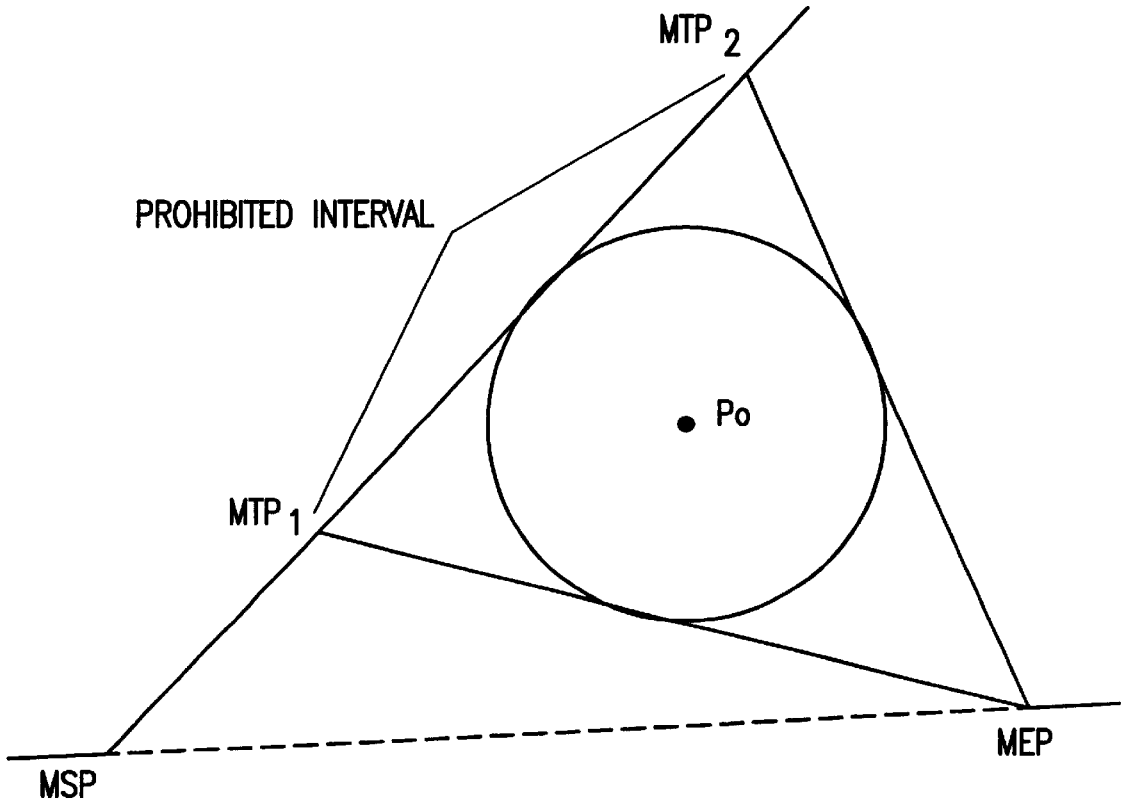
FIG. 12 illustrates the calculation of multiple turnback points solutions.

Referring to FIGS. 11–12, the prohibited turnback interval is calculated in accordance with the LMG algorithm of the present invention, in which the following new parameters are introduced:

$\overline{Vnr}$—the relative velocity vector after turning back toward the maneuver end point (MEP); and $\overline{Vns}$—the subject aircraft velocity vector after turning back toward the MEP.

The problem is to find the one or two turnback points (MTP) where the subject aircraft can turn back toward the MEP and pass at a distance SEPMR from the object aircraft. LMG uses an iterative technique to solve this problem. In each iteration a better estimate of the return-leg bearing is determined. Iteration continues until successive estimates of the return-leg bearing differ by less than epsilon. The initial estimate of the return-leg bearing is simply the subject aircraft bearing prior to beginning the maneuver. The algorithm for finding one of the turnback points is described below.

RETURN_BEARING =bearing($\overline{Vs}$)

do until RETURN_BEARING converges $\overline{Vns}$=groundspeed vector for subject aircraft in direction RETURN_BEARING $$\overline{Vnr}=\overline{Vns}-\overline{Vo}$$

The two points (relative coordinate system) where $\overline{Vnr}$ is tangent to the protection circle are given by:

TAN_PT(1)=(SEPMR*cos (bearing($\overline{Vnr}$)),–SEPMR*sin(bearing($\overline{Vnr}$)))

TAN_PT(2)=(SEPMR*cos(bearing($\overline{Vnr}$)), SEPMR*sin (bearing($\overline{Vnr}$)))

The maneuver turnback point (relative coordinate system) is the intersection of the off-leg and the return-leg:

$\overline{MTP}$ r=intersection point of line through $\overline{Pr}$ at bearing of $\overline{Vbr}$ and line through TAN_PT at bearing of $\overline{Vnr}$.

The distance from MSP to MTP (relative coordinate system) is given by:

$$DIST_r=|\overline{MTP}_r-\overline{Pr}|$$

The time to cover this distance is given by:

$$DURATION = \frac{(DIST_r)}{|\overline{Vbr}|}$$

Returning to the ground coordinate system, the distance from MSP to MTP is:

$$DIST=DURATION*|\overline{Vbs}|$$

and the MTP (ground coordinate system) is given by:

$$MTP = MSP + DIST * \left(\frac{\overline{Vbs}}{|\overline{Vbs}|}\right)$$

RETURN_BEARING=bearing from MTP to MEP

END do until RETURN_BEARING converges.

The MTP can occur after the aircraft are vertically separated. To account for this, LMG determines the time after the end of the conflict when vertical separation is regained. The MTP point is constrained to never be any later than this time. When addressing a metering problem, the MTP interval may be extended to provide the delay needed to the required metering time. To reduce the size of the resultant delay maneuver, the speed of the aircraft may also be reduced.

For cases involving the primary conflict, there will be only one MTP solution, and turning back prior to that MTP will result in a conflict. In this case, the MTP interval will extend from the MSP to the MTP. However for cases involving an objection, there may be two MTP solutions. Turning back within this prohibited interval will result in a conflict. This situation is shown in FIG. 12. In this case, the MTP interval for this objection will extend from the first to the second MTP solution.

Rejoin Angle Processing Loop

After the MTP 112 is selected a rejoin angle 120 is calculated. The rejoin angle 120, as shown in FIG. 10 is the absolute difference between the inverse bearing 122 of the subject aircraft's trajectory at the MEP and the bearing 124 from the MEP to the MTP. If the rejoin angle 120 is less than an adapted value (20°), then LMG procedure has created a two leg maneuver that avoids all known conflicts and LMG terminates by signaling PARR control loop to build a set of planned actions for this maneuver.

If the rejoin angle 120 calculated is larger than the adapted limit LMG performs the following functions:

(1) LMG moves the MEP downstream to the next fix. If the MEP is moved past the facility planning region or the end of the trajectory, then no MOA solution is feasible. Under these conditions, no further lateral maneuvers are generated in the specified turn direction and LMG terminates.

(2) Due to the fact that the MTP was moved a new set of MTP intervals is calculated as previously described for each known conflict.

(3) An MTP is chosen that does not intercept any new MTP intervals.

(4) The rejoin angle is recalculated in steps 1–4 which will be repeated until either the MEP has finally been moved past the facility planning region or end of the trajectory, or a rejoin angle is finally found that is acceptably small.

If the final rejoin angle is less than an adapted value, then LMG has created a two leg maneuver that avoids all known conflicts and LMG terminates by signaling the control loop to build a set of planned actions for this maneuver. The flow chart diagram of PARR control loop executing the lateral maneuver generation procedure described in previous paragraphs will be described in detail with regard to FIGS. 16–19 in further paragraphs.

In addition to generating lateral maneuvers PARR also generates vertical maneuver description and longitudinal maneuver description. PARR vertical maneuver generation control loop calculates a block of air space that the aircraft must avoid.

The algorithms are rule based using aircraft transitioning status, planned maneuver times and problem start/end times to generate resolutions using predefined maneuver shapes. These shapes are categorized according to whether the maneuvered aircraft passes above the original problem region (termed "above problem" maneuvers), or below the original problem region ("below problem" maneuvers).

Figure 13:
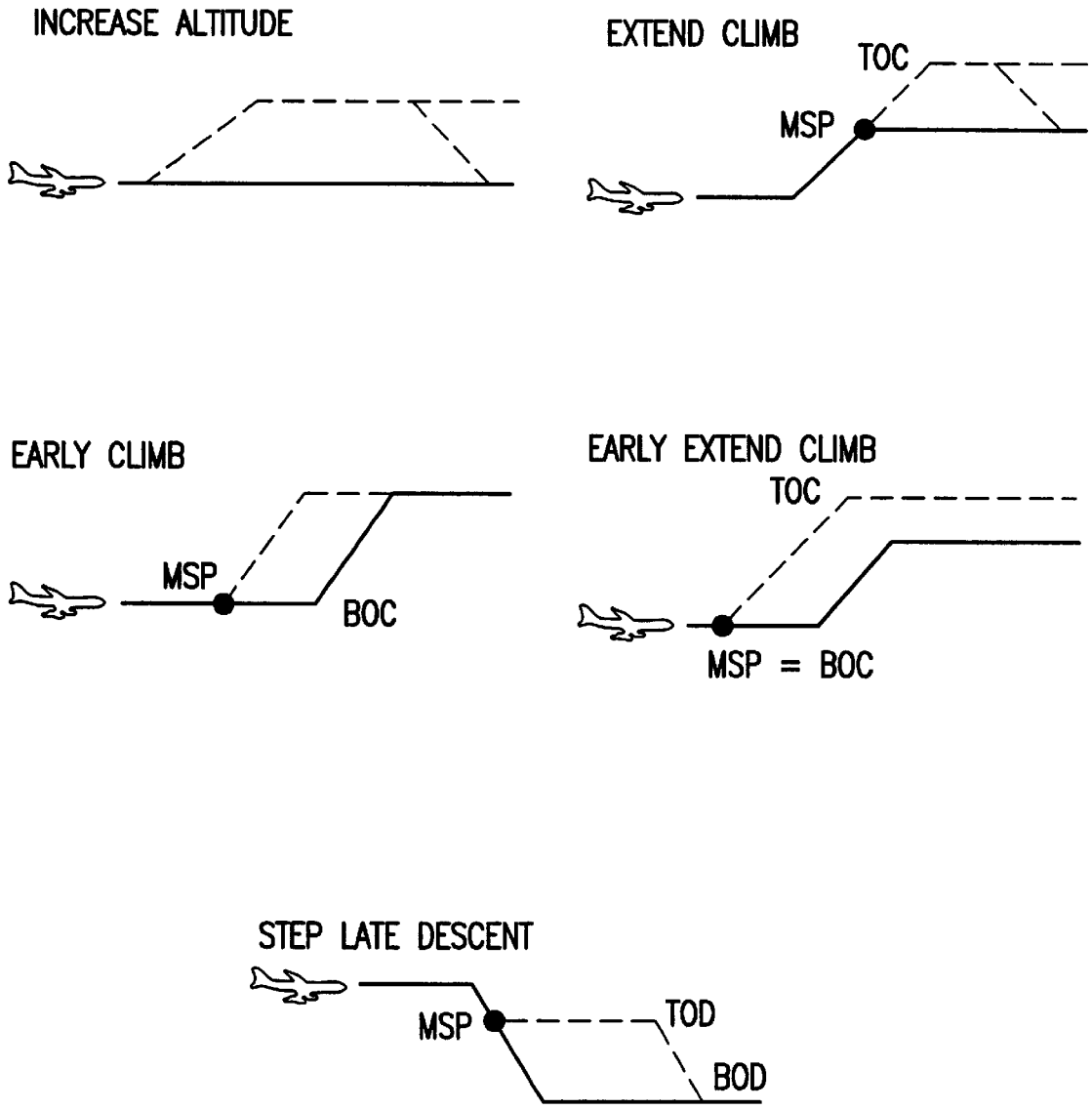
FIG. 13 illustrates vertical above problem maneuever shapes.

As illustrated in FIG. 13, the above problem maneuver shapes include Increased Altitudes, Extent Climb, where the aircraft "climbs" from the maneuver start point to the top of climb (TOC), Early Climb where the maneuvered start point is prior to the bottom of a climb (BOC), Early Extent Climb where the maneuvers start point coincides with BOC, and Step Late Descent which includes the case where the step-wise maneuver from the MSP through TOD (top of descent) to the BOD (bottom of descent). These maneuvers were derived on the basis of extensive evaluations and analysis as part of the (AERA) automated en route air traffic control program. While other maneuver shapes are technically possible, i.e., for example, an Early Climb combined with a Step Maneuver, these types of maneuvers are currently not implemented in PARR due to issues with operational acceptability and restricted applicability to unusual multiple problem encounters.

Figure 14:
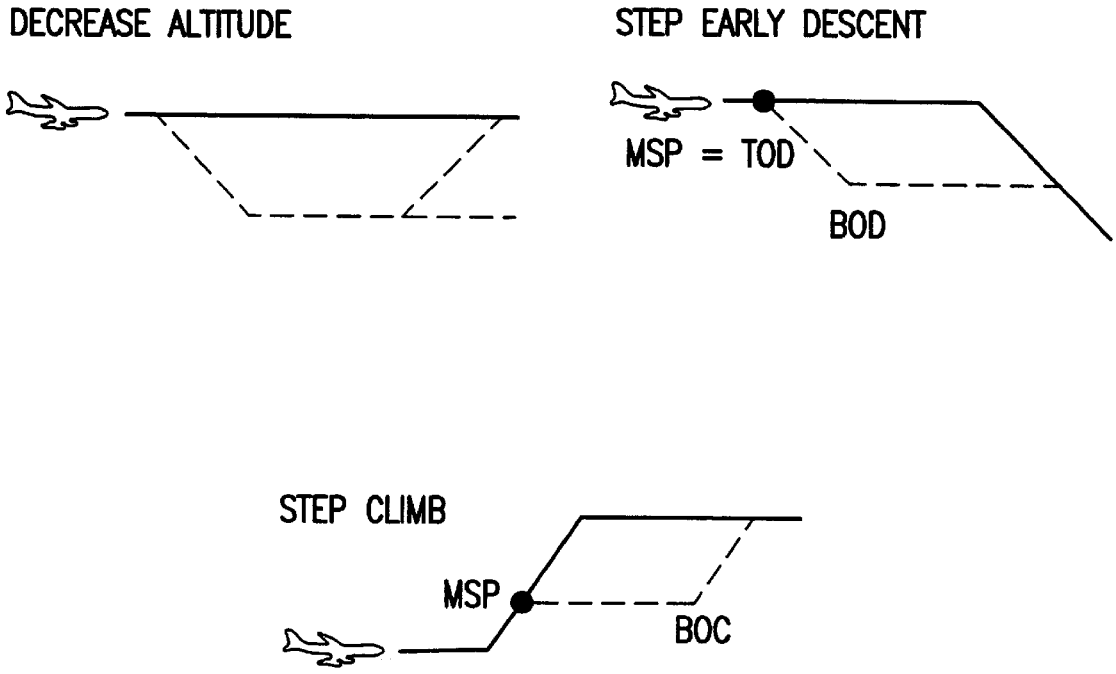
FIG. 14 illustrates vertical below problem maneuever shapes.

After an appropriate maneuver shape has been selected the PARR varies the maneuver transition points indicated in FIGS. 13 and 14, using problem information obtained from the previous attempt.

As illustrated in FIG. 14, the below problem maneuver shapes are Decreased Altitude, Step Climb, and Step Early Descent which include the case of an Early Descent when there is a future level off prior to the arrival airport. The maneuvers shown in FIGS. 13 and 14 are self-explanatory and not detailed in further description.

Figure 15:
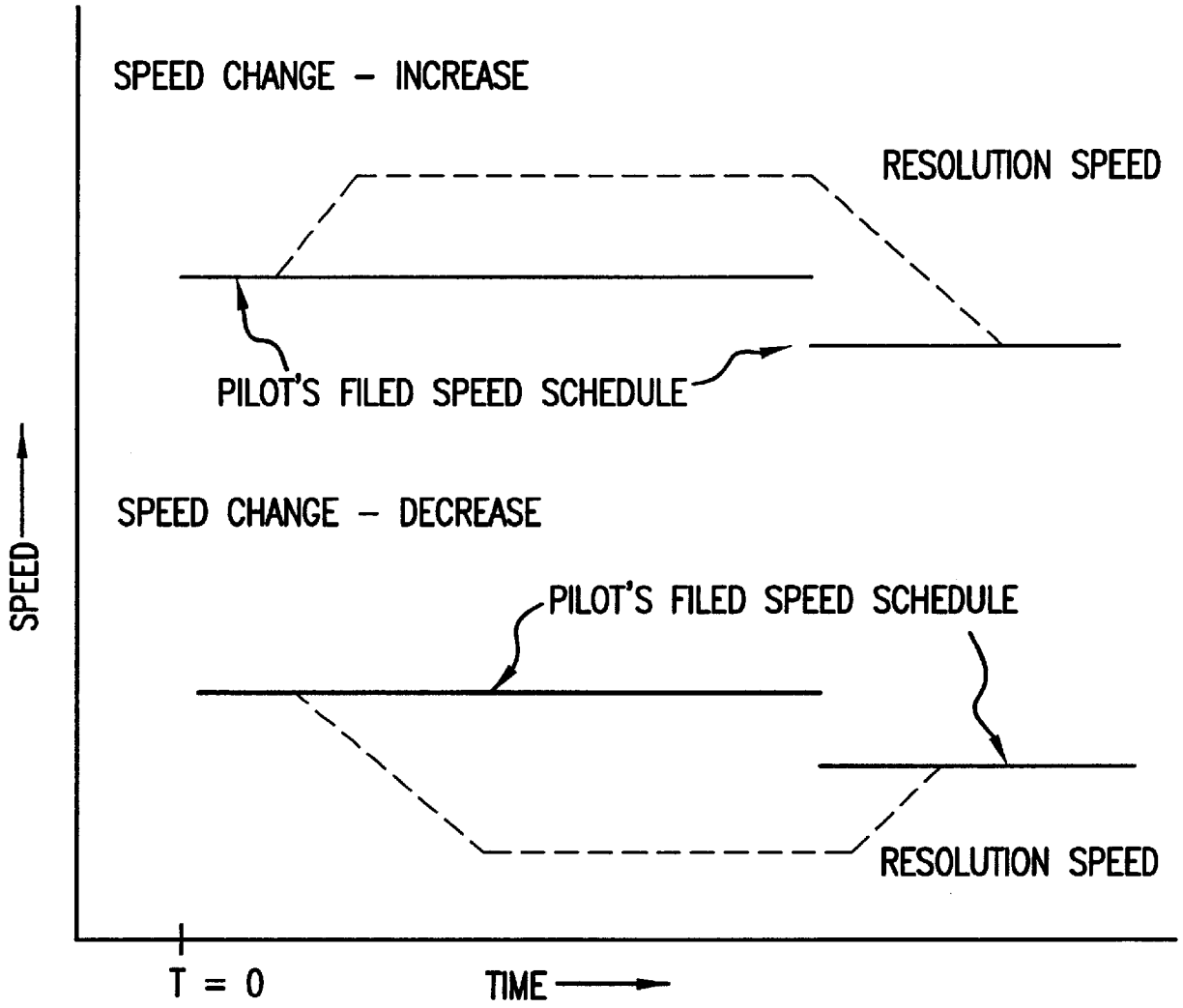
FIG. 15 illustrates longitudinal maneuvers.

Longitudinal maneuvers, as shown in FIG. 15, consist of either a speed increase or decrease, followed by the time at which the currently planned speed may be resumed. At most, one speed change maneuver for a given aircraft is presented to the flight controller.

After the resolutions are generated PARR follows to the third step of PARR software algorithm which is called resolution ranking. In this step, the completed resolutions are sorted according to anticipated air space user and controller preferences to facilitate the resolution selection process.

Displayed clearance information, which does not assume any particular aircraft equipage, is specified in terms of heading changes, VORs, VOR radials, altitudes, and speeds. The clearance information on the Plans Display is abbreviated as described in Table I.

TABLE I

ABBREVIATED CLEARANCE INFORMATION

| Standard Form | Abbreviated Form |
|---|---|
| turn left | L |
| turn right | R |
| deg | ° |
| fly present heading | fph |
| at HHMMZ(ΔMM) . . . | [ΔMM . . . ] |

TABLE II

RESOLUTION COUNT SUMMARIES
INDIANAPOLIS CENTER

| | |
|---|---|
| Total Conflicts-Tactical and Non-Tactical | 2299 |
| Non-Tactical Conflicts-Conflict Start > 3 min | 1794(78.0%) |
| Green Resolutions from Non-Tactical | 4201(72.2%) |
| Red Resolutions from Non-Tactical | 616(10.6%) |
| Yellow Resolutions from Non-Tactical | 784(13.5%) |
| Blue Resolutions from Non-Tactical | 221(3.8%) |
| Non-Tactical Conflicts with At Least one Green | 1634(91.1%) |

To help quantify PARR resolution results, an automated test program is used. If a problem is found in the conflict database, PARR is initiated for an aircraft involved in the problem, and the results of PARR execution (number of resolutions with red, yellow, blue, and green color codes) are collected and tabulated. The results from a test run are shown in Table II. These results indicate that in over 90 percent of non-tactical problem situations (i.e., the problem begins within at least three minutes after PARR is invoked), PARR is able to construct at least one green (problem free) resolution for a given aircraft.

Resolutions to Comply with Assigned Metering Times

PARR enhancement has been developed to generate maneuvers that meet a specified meter fix time (MFT) constraint in addition to avoiding aircraft-to-aircraft and aircraft-to-airspace problems. This concept is much the same as for the initial PARR capabilities; however, instead of initiating PARR to generate resolutions for a separation problem, PARR is initiated for a MFT problem (i.e., an aircraft is predicted to miss the assigned MFT). The procedures for implementing and displaying the metering resolution are similar to those described in previous paragraphs. Once initiated, PARR searches for maneuvers that meet the MFT with a trajectory that is free of problems with non-metered aircraft (e.g., crossing traffic), and with metered aircraft that are predicted to meet their assigned MFT.

If delay to meet an MFT is required, PARR resolution initially reduces the aircraft's speed to an acceptable minimum (for fuel efficiency and to reduce the size of vector maneuvers) and then adds lateral delay as needed. In the event an earlier arrival time is required, the route is shortened when possible with a speed increase added as necessary to meet the MFT. Where applicable, lateral maneuvers for both left and right of route are generated.

Lateral Maneuver Generation Flowchart

Figure 16:
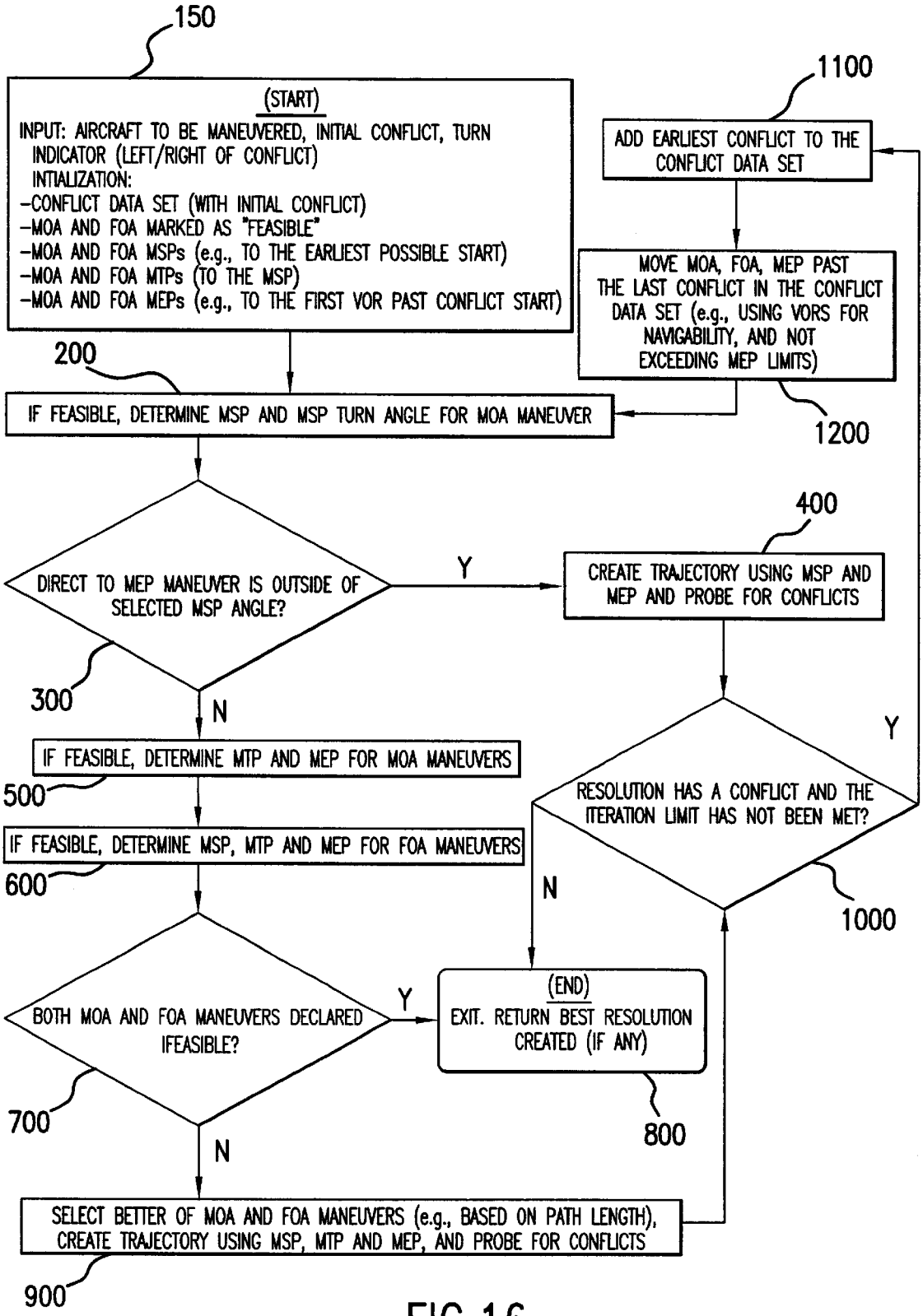
FIG. 16 is a representation of a flow chart diagram of a PARR algorithm of the present invention for generating a lateral maneuver.

Referring to FIG. 16, the flow chart diagram of PARR procedure starts with the block 150 in which the data concerning the aircraft to be maneuvered, initial conflict found in the space surrounding the aircraft, and turn indicator (defining the direction of a turn to be made to avoid the conflict) are input into the system. To start PARR procedure, a conflict data base is formed which includes the initial conflict and the MOA and FOA are marked as "feasible".

Calculation of the Maneuver Start Points for MOA and FOA, Maneuver Turning Points of the MOA and FOA, as well as Maneuver End Points of the MOA and FOA, starts with the logic following to the block 200 "If feasible, determine MSP and MSP turn angle for MOA maneuver". The MSP and MSP turn angle is calculated in accordance with the flow chart diagram shown in FIG. 17 which will be discussed in detail in further paragraphs.

Figure 18:
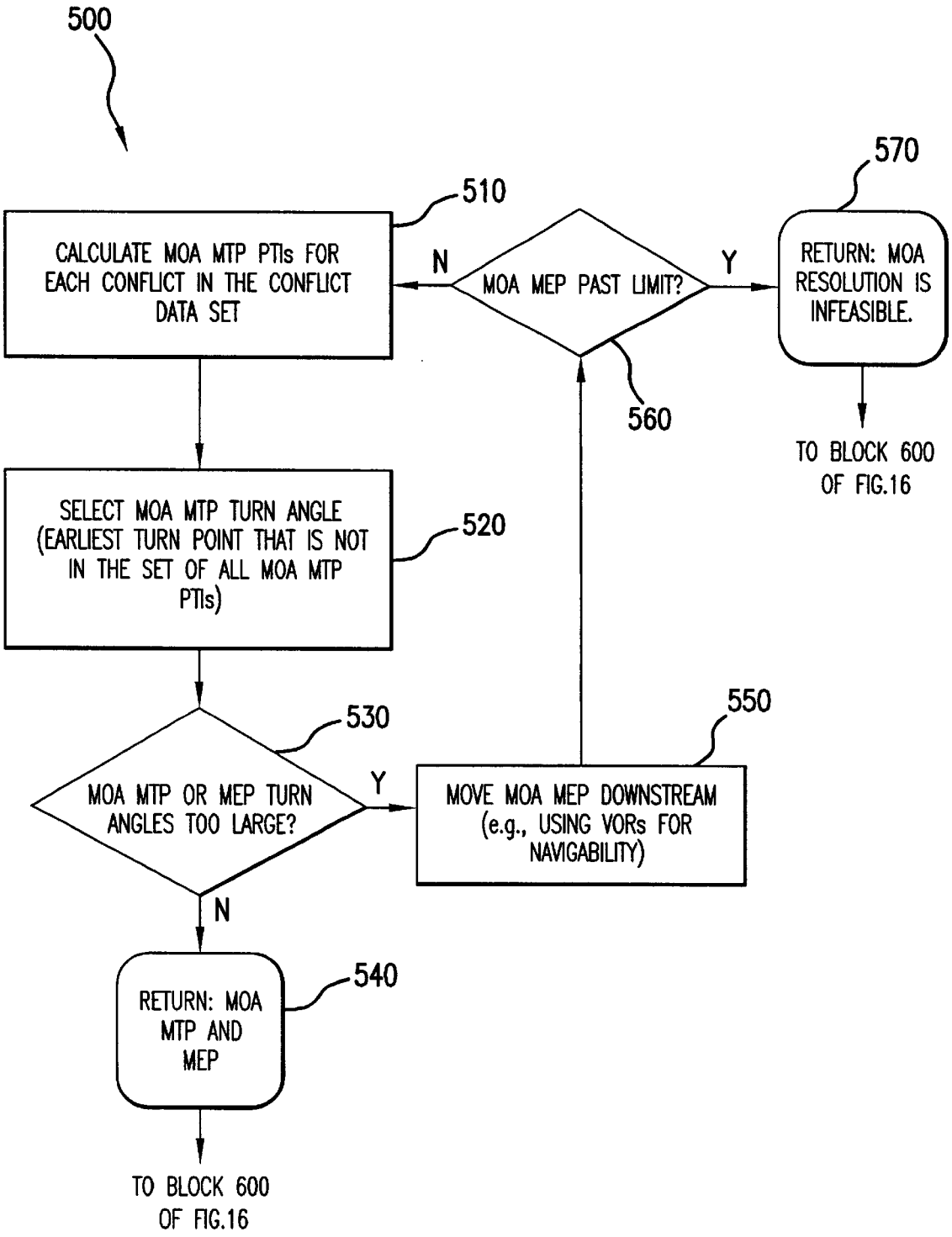
FIG. 18 is a representation of a flow chart showing the procedure of determination of the MTP and MEP for MOA maneuvers.

Upon the determination of MSP and MSP turn angle for MOA maneuver is completed in the block 200, the logic flows to the block 300 "Direct to MEP maneuver is outside of selected MSP angle?" If the direct to MEP maneuver is outside of the selected MSP angle, the logic flows from the block 300 to the block 400 "Create trajectory using MSP and MEP and probe for conflicts". If however, the direct to MEP maneuver is not outside of the selected MSP angle, the logic flows to the block 500 "If feasible, determine MTP and MEP for MOA maneuvers". The procedure run by the block 500 is shown in FIG. 18 and is discussed in detail in further paragraphs.

Figure 19:
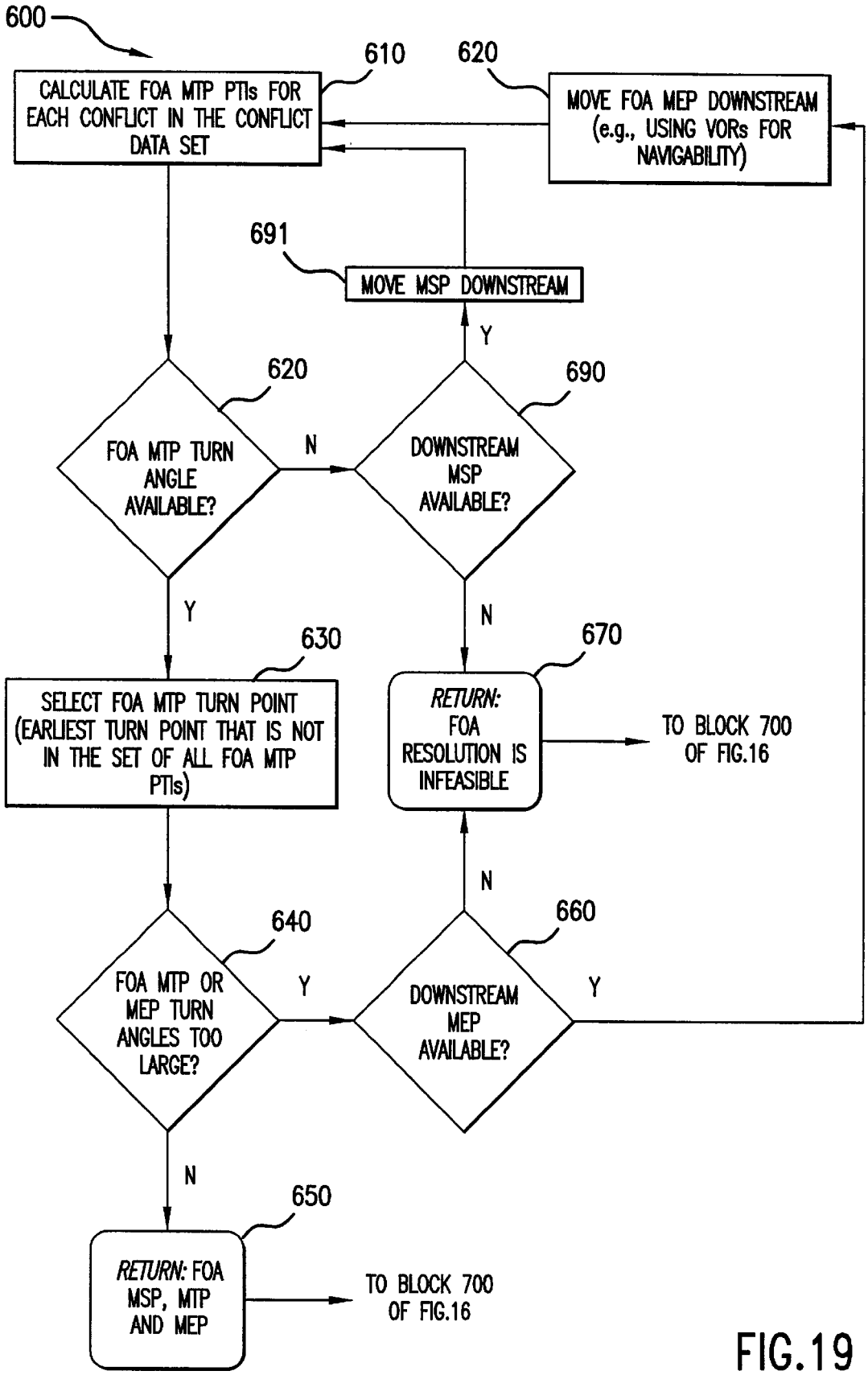
FIG. 19 is a representation of a flow chart of the procedure for calculation of the MSP, MTP and MEP for FOA maneuvers.

Upon completing the procedure determining MTP and MEP for MOA maneuvers in the block 500, the flow chart further follows to block 600 "If feasible, determine MSP, MTP and MEP for FOA maneuvers". The procedure ran in the block 600 is best shown in FIG. 19 and is discussed in detail in further paragraphs.

Upon completing the procedure of calculating the MTP and MEP for FOA maneuvers in the block 600 the logic flows to the logic block 700 "Both MOA and FOA maneuvers declared infeasible?". If "Yes", the procedure ends in the block 800 "Exit-Return best resolution". If however, both MOA and FOA maneuvers are declared to be feasible, the flow chart proceeds to the block 900 "Select better of MOA and FOA maneuvers (e.g., based on test length), create trajectory using MSP, MTP, and MEP, and probe for conflicts".

Upon selecting the most appropriate MOA and FOA maneuver, creating a trajectory using the maneuver parameters calculated in blocks 200, 500, and 600, and then probing for additional conflicts, the logic flows from the block 900 to the block 1000 "Resolution has a conflict and the iteration limit has not been met?".

If the resolution is conflict-free and the iteration limit has been met, the logic flows from the block 1000 to the block 800 to end the procedure. If, however, the resolution includes a conflict and the iteration limit has not been met, the flow chart proceeds from the block 1000 to the block 1100 "Add earliest conflict to the conflict data set". Wherein the newly discovered conflict is added to the conflict data base.

In the next step, the logic flows from the block 1100 to the block 1200 "Move MOA, FOA, MEP past the last conflict in the conflict data set (e.g., using VORs for navigability, and not exceeding MEP limits)". Upon completing the procedure in the block 1200, the logic returns to the block 200 for looping through the block 200 through 800 for a newly discovered conflict and if needed, follows further through block 1000 through 1200 until both MOA and FOA maneuvers are declared infeasible (in block 700), the iteration limit is exceeded, or the newly created resolution is conflict free (in block 1000).

Figure 17:
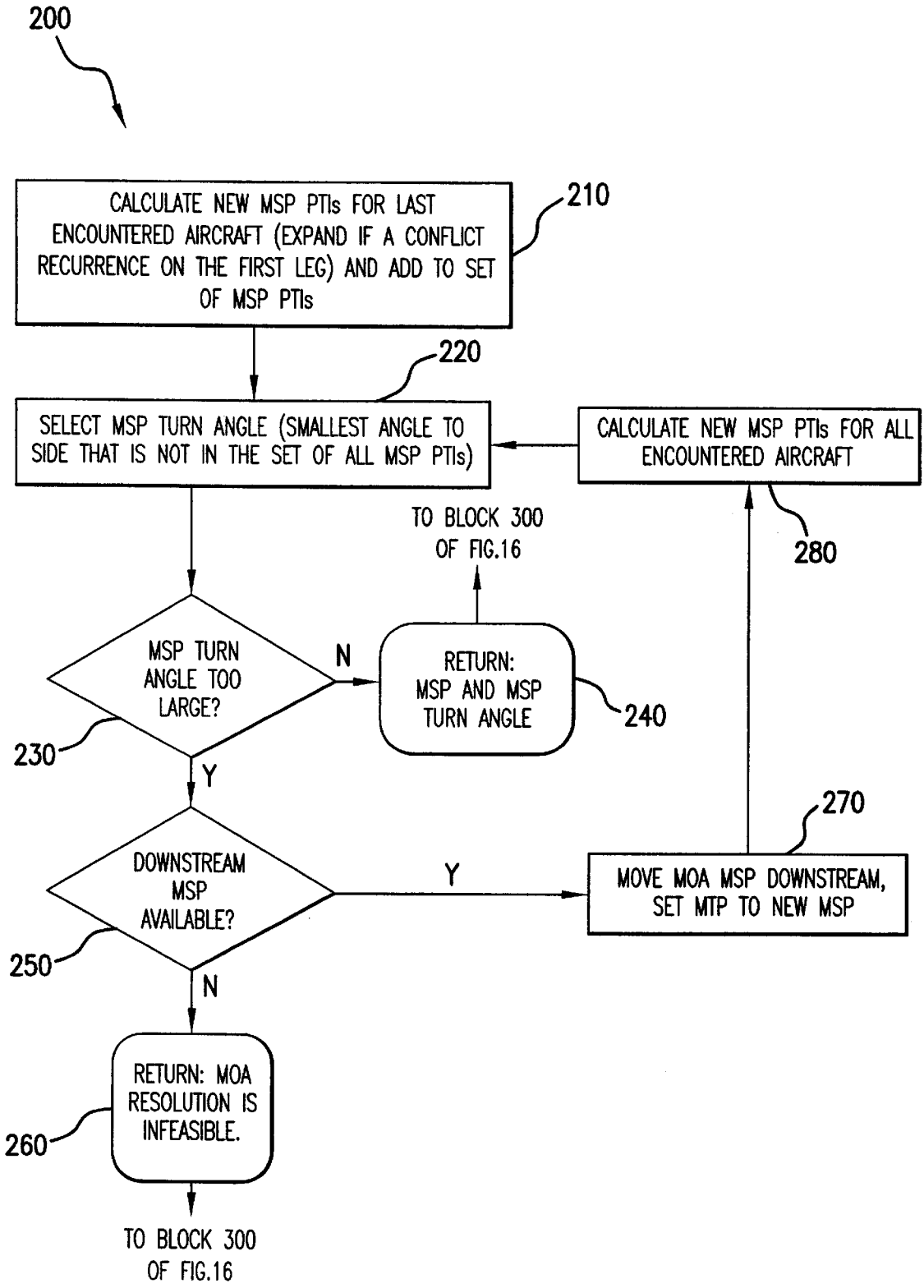
FIG. 17 is a representation of a flow chart of the procedure for calculation of the MSP angle for Minimum Off Angle (MOA) maneuvers.

Proceeding further to FIG. 17, the determination of MSP and MSP turn angle for MOA maneuver in block 200 starts with the block 210 "Calculate new MSP PTIs for less encountered aircraft (expand if a conflict recurrence on the first leg) and add to set of MSP PTIs", wherein PTIs stand for Prohibited Turn Intervals. In this block 210, calculation is performed for each new conflict after the maneuver for the initial conflict has been calculated as described in previous paragraphs.

Upon completion, the procedure in the block 210, the logic flows to the block 220 "Select MSP turn angle (smallest angle to side that is not in the set of all MSP PTIs)". After the smallest MSP turn angle has been selected in the box 220, the procedure flows to the box 230 "MSP turn angle too large?". If the MSP turn angle is not too large, the logic follows to the block 240 "Return: MSP and MSP turn Angle" from where the logic returns to block 300 of FIG. 16.

If, however, the MSP turn angle selected in the block 220 is too large, the logic flows to the logic block 250 "Downstream MSP available?". If the downstream MSP is not available, then the flow chart proceeds to the block 260 "Return: MOA resolution is infeasible" wherefrom the logic follows to the block 300 of FIG. 16. If, however, the downstream MSP is available, the flow chart proceeds from the block 250 to block 270 "Move MOA MSP downstream, set MTP to new MSP", from where the procedure follows to the block 280 "Calculate new MSP PTIs for all encountered aircraft" and afterwards loops to the block 220 for finding an appropriate MSP and MSP turn angle for MOA maneuver.

Upon determining MSP angle for MOA maneuver in the block 200, the details of which are shown in FIG. 17, the logic proceeds as discussed in previous paragraphs to the logic block 300 and from there either to the block 400 or to the block 500 the details of which are shown in FIG. 18.

The procedure of block 500 starts in the block 510 "Calculate MOA MTP PTIs for each conflict in the conflict data set". When calculation in the block 510 is completed, the flow chart proceeds to the block 520 "Select MOA MTP turn angle (earliest turn point that is not in the set of all MOA MTP PTIs)".

Upon the selection of the earliest turn point in the block 520 is made, the flow chart proceeds to the logic block 530 "MOA MTP or MEP turn angles too large?" If not, the logic flows to the block 540 "Return: MOA MTP and MEP" from where the parameters of the maneuver are submitted to the block 600 shown in FIG. 16.

If however the MOA MTP or MEP turn angles are too large in block 530, the procedure follows to block 550 "Move MOA MEP downstream (e.g., using VORs for navigability)". Upon completion of the procedure in block 550, the logic flows to block 560 "MOA MEP past limit?". If"Yes", the flow chart moves to the block 570 "Return: MOA resolution is infeasible" which is the output of block 500 of FIG. 16. If however, the MOA MEP path is within the established limits in block 560, the logic returns to block 510 for calculation of MOA MTP PTIs for each conflict in the conflict data set.

Upon completion of the procedure in the block 500, the flow chart shown in FIG. 18 further flows to the block 600, as described in the previous paragraphs. The details of the logic block 600 are clearly shown in FIG. 19, where the procedure in block 600 starts in block 610 "Calculate FOA MTP PTIs for each conflict in the conflict data set". Upon such a calculation, the flow chart follows from block 610 to block 620 "FOA MTP turn point available?" wherefrom, if such a turn point is available (i.e., the prohibited turn intervals do not cover the MSP), the earliest such turn point is selected in the block 630 procedure "Select FOA MTP turn point". Following this selection, the resultant turn angles at the MTP and MEP are calculated. If both the MTP and MEP turn angles are within their parameter limits, the logic flows to Block 650 "Return: FOA MSP, MTP and MEP" and the parameters of the maneuver are submitted to block 700 of FIG. 16.

If, however, either the MTP or MEP turn angles exceed their predetermined limits, the logic flows from block 640 to block 660 "Downstream MEP available?" If a downstream MEP is available, a new MEP is selected in Block 680 (e.g., by a selecting a VOR for ease of clearance and navigability), and the processing beginning with block 610 is repeated using the new MEP. If, however, no downstream MEP is available, then the flow chart proceeds to block 670 "Return: FOA Resolution is infeasible" and then to block 700 of FIG. 16.

If an FOA MTP turn point is not available in block 620, the flow chart proceeds to block 690 "Downstream MSP available?" If a downstream MSP is available, a new MSP is selected in Block 691 and the processing beginning with block 610 is repeated using the new MSP. If, however, no downstream MSP is available, then the flow chart proceeds to block 670 "Return: FOA Resolution is infeasible" and then to block 700 of FIG. 16.

Expected PARR Benefits

It is expected that PARR will make significant contributions to the attainment of the key (Air Traffic Control) system goals: safe, orderly, expeditious air traffic flow, and increased controller productivity. These contributions are summarized below:

Enhanced safety—Safety enhancement is important since the relaxation of ATC restrictions can lead to more complex traffic patterns. PARR assists in maintaining or enhancing safety in two ways. First, PARR provides tools with which flight controllers can obtain an improved, strategic situational understanding, e.g., by quickly indicating which altitude, speed, or direct-to-fix alternatives are problem-free. Second, the resolutions provided by PARR allows the controller to more easily implement strategic problem-free resolutions. The strategic nature of these resolutions will allow increased time for decision-making and coordination.

Controller workload reduction—PARR reduces controller workload in the problem resolution process by: 1) suggesting specific resolutions; 2) indicating successful and failed resolution dimensions/directions; and, 3) generating resolutions that will be less likely to cause downstream problems than tactical resolutions.

Improved flight information for use in trajectory modeling—PARR increases the potential for flight plan amendments to be entered into the Host computer (e.g., by providing route modifications that may be entered into the Host, versus incomplete vector clearances which cannot be entered). Since trajectory modeling accuracy is in part a function of the degree to which flight plan data represents the intended path of the aircraft, this increased potential improves modeling accuracy.

Resolution efficiency—PARR computes efficient maneuver parameters using detailed aircraft performance and atmospheric data, and examines a variety of dimensions and directions for increased resolution efficiency. Additionally, the efficiency of these parameters is independent of the amount of traffic in the sector. PARR also facilitates a strategic problem resolution approach that reduces the number of large, tactical maneuvers.

Increased user benefits—PARR increases user benefits by enabling the accommodation of greater numbers of aircraft operating in less structured airspace. Strategic planning and problem solving also allows more time for controllers to address requests from the airspace users, and PARR capabilities facilitate the granting of these requests. Finally, the efficiency of PARR resolutions reduces deviations from the user-preferred flight profile when maneuvers are required.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A method for generating problem resolutions for free flight operations in air traffic control, comprising the steps of:

selecting a subject aircraft to be maneuvered;

iteratively examining continuous space enveloping said subject aircraft for potential aircraft problems for a predetermined look-ahead time interval defining a plurality of examination passes;

in each iterative examination pass, generating resolutions in response to all problems encountered in said examined continuous space, each resolution proposing a predefined type of maneuver for said subject aircraft;

calculating parameters of requested maneuvers based on relative motion geometry, and probing each said generated resolution by examining said continuous space enveloping said subject aircraft affected by each requested maneuver applied thereto.

2. The method of claim 1, wherein said proposed maneuver includes a lateral maneuver chosen from the group consisting of a Direct to Maneuver End Point, a Minimum Off-Angle, and a Fixed Off-Angle.

3. The method of claim 2, further comprising the steps of:

creating a conflict data base including first and second conflict databases for generating maneuvers to the left and right turn of the initial conflict, respectively, said conflict data base containing an initial problem, during each examination pass of said continuous space, adding data of newly discovered conflicts to a respective one of said first and second databases, and generating a resolution requesting the lateral maneuver to avoid each conflict stored in said first and second conflict databases.

4. The method of claim 3, further comprising the steps of:

determining a maneuver start point (MSP) for a minimum off-angle (MOA) maneuver by:

(a) determining an initial MOA MSP starting at a parameter time in the future, (b) for each conflict within said conflict database, calculating a set of MSP prohibited turn intervals, (c) selecting the smallest MSP turn angle outside of said set of MSP prohibited intervals, (d) moving said initial MSP down trajectory of said subject aircraft if said selected smallest MSP turn angle exceeds a predefined angle value, and (e) repeating said steps (b)–(d) for all encountered conflicts stored in said conflict database until said selected smallest MSP turn angle meets said predefined angle value.

5. The method of claim 4, further comprising the steps of:

determining a maneuver turn point (MTP) and a maneuver end point (MEP) for the MOA maneuver by:

(f) determining an initial MEP for the MOA maneuver, said MOA maneuver being the next fix downstream of the end of said initial conflict, (g) calculating a set of MSP and MTP prohibited turn intervals for each conflict in said conflict database, (h) selecting the MSP and MTP turn angles outside said set of MSP and MTP prohibited turn intervals, and (i) moving said initial MEP for the MOA maneuver down trajectory of said subject aircraft if said selected MTP or resultant MEP turn angles exceed predefined limits.

6. The method of claim 5, further comprising the steps of:

determining MSP, MTP and MEP for a fixed off-angle (FOA) maneuver by:

(j) determining an initial FOA MSP starting at a parameter time in the future, (k) determining an initial MEP for the FOA maneuver, said FOA maneuver being the next fix downstream of the start of said initial conflict, (l) calculating a set of MTP prohibited turn intervals for each conflict in said conflict database, (m) moving the MSP downstream until outside of said set of MTP prohibited turn intervals, (n) selecting the MTP turn angles outside said set of MTP prohibited turn intervals, and (o) moving said initial MEP for the FOA maneuver down the trajectory of said subject aircraft if said selected MTP or resultant MEP turn angles exceed predefined limits.

7. The method of claim 6, further comprising the steps of:

selecting a better of said MOA and FOA maneuvers based on predefined criteria, creating the selected maneuver trajectory, probing said created trajectory of said selected maneuver for problems, and acknowledging said created maneuver trajectory as the most appropriate if said maneuver trajectory is conflict free.

8. The method of claim 7, further comprising the steps of:

adding to said conflict database the information of each conflict encountered during said probing of said created maneuver trajectory, moving said MEP calculated for the MOA and FOA maneuvers past the last conflict in said conflict database, and repeating said steps (a)–(o) until said created maneuver trajectory is problem free.

9. The method of claim 1, further comprising the steps of:

generating resolutions to meet assigned metering time constraints for said subject aircraft by including MTPs violating the metering constraint in the set of MTP prohibited turn intervals, and reducing the size of the resultant delay maneuver by reducing the speed of the aircraft.

10. The method of claim 1, further comprising the steps of:

defining a conflict free path constraint for said subject aircraft comprising at least one straight line flight segment, defining start point, end point, turn point, and off-angle of the maneuver, and re-routing said subject aircraft through a series of fixes respective to said flight segment in predefined off-angle parameter increments starting at said start point, turning said subject aircraft at said turn point, and returning said subject aircraft to said flight segment at said end point of the maneuver.

11. The method of claim 1, further comprising the steps of:

assigning to said subject aircraft a specific maneuver and evaluating the merits of said specific maneuver by generating said plurality of resolutions in response thereto.

12. The method of claim 1, further comprising the steps of:

(a) forming a problem summary structure, (b) collecting data including:

said subject aircraft's headings, speeds, and transitioning states at the current time;

the encountered problem's start and end times, and predicted headings, speeds, and transitioning states of said subject aircraft at said start and end times;

minimum and maximum altitudes and true airspeeds of said subject aircraft; and sector and facility currently controlling said subject aircraft;

(c) storing said data in said problem summary structure, and (d) processing said data for generating and ranking the resolutions.

13. The method of claim 1, wherein said maneuvers are compatible with the operational performance envelope of said subject aircraft.

14. The method of claim 1, wherein the maneuver's parameters include: turn angles of said maneuvers calculated and displayed in predefined magnitude increments.

15. The method of claim 1, wherein each said generated resolution, upon completing said maneuver, returns said subject aircraft to a pre-conflict route or destination.

* * * * *